US011672336B2

(12) United States Patent
Duesler et al.

(10) Patent No.: US 11,672,336 B2
(45) Date of Patent: Jun. 13, 2023

(54) MODULAR TUBE FRAME CABINET SYSTEM

(71) Applicant: Food Concepts, Inc., Middleton, WI (US)

(72) Inventors: Brad J. Duesler, Middleton, WI (US); Zachary J. Duesler, Middleton, WI (US)

(73) Assignee: Food Concepts, Inc., Middleton, WI (US)

( * ) Notice: Subject to any disclaimer, the term of this patent is extended or adjusted under 35 U.S.C. 154(b) by 58 days.

(21) Appl. No.: 17/143,205

(22) Filed: Jan. 7, 2021

(65) Prior Publication Data

US 2021/0204691 A1 Jul. 8, 2021

Related U.S. Application Data

(60) Provisional application No. 62/958,447, filed on Jan. 8, 2020.

(51) Int. Cl.

| | |
|---|---|
| ***A47B 47/00*** | (2006.01) |
| ***A47B 96/18*** | (2006.01) |
| *A47G 19/32* | (2006.01) |
| *G09F 7/18* | (2006.01) |
| *A47F 1/04* | (2006.01) |

(52) U.S. Cl.

CPC ..... *A47B 47/00* (2013.01); *A47B 96/18* (2013.01); *A47F 1/04* (2013.01); *A47G 19/32* (2013.01); *G09F 7/18* (2013.01); *G09F 2007/1804* (2013.01)

(58) Field of Classification Search

CPC ..... A47B 47/00; A47B 47/05; A47B 47/0091; A47B 96/18; A47B 47/028; A47B 47/0058; A47B 96/1441; A47F 1/04; A47G 19/32

USPC ..... 312/257.1

See application file for complete search history.

(56) References Cited

U.S. PATENT DOCUMENTS

| | | | | | |
|---|---|---|---|---|---|
| 2,678,489 | A | * | 5/1954 | Ratzlaff | B25H 1/02 29/721 |
| 2,918,176 | A | * | 12/1959 | Bell | A47B 47/027 211/187 |
| 3,123,416 | A | * | 3/1964 | Sovik, Jr. | A47B 17/006 312/351.8 |
| 3,362,768 | A | * | 1/1968 | Fink | A47B 95/008 312/257.1 |
| 3,642,310 | A | * | 2/1972 | Hudson | F16B 7/0446 160/381 |

(Continued)

FOREIGN PATENT DOCUMENTS

| | | | | |
|---|---|---|---|---|
| GB | 2508658 | * | 6/2014 | A47B 77/02 |

*Primary Examiner* — James O Hansen

(74) *Attorney, Agent, or Firm* — Bell & Manning, LLC

(57) ABSTRACT

A cabinet system includes a first vertical end support and a second vertical end support. The first vertical end support and the second vertical end support are each formed from a plurality of metal tubes. The cabinet system also includes a plurality of horizontal stringers that extend between the first vertical end support and the second vertical end support. One or more of the horizontal stringers is configured to support a countertop. The cabinet system further includes a plurality of lateral stringers that extend between the first vertical end support and the second vertical end support. At least one of the lateral stringers is a toe kick.

17 Claims, 23 Drawing Sheets

(56) References Cited

U.S. PATENT DOCUMENTS

| | | | | | |
|---|---|---|---|---|---|
| 3,773,184 | A * | 11/1973 | Brennan | A47B 61/003 | 211/123 |
| 3,877,765 | A * | 4/1975 | Hassing | A47B 47/00 | 312/111 |
| 4,392,436 | A * | 7/1983 | Weiler | F16B 12/52 | 108/81 |
| 4,793,667 | A * | 12/1988 | Gilliom | A47B 47/03 | 312/263 |
| 4,883,330 | A * | 11/1989 | Armstrong | A47B 21/06 | 312/195 |
| 5,590,939 | A * | 1/1997 | Piontek | A47B 88/988 | 108/26 |
| 10,039,374 | B2 * | 8/2018 | Abraham | A47B 13/088 | |
| 2007/0194673 | A1 * | 8/2007 | Kvols | A47B 96/1466 | 312/257.1 |
| 2010/0079042 | A1 * | 4/2010 | Eilers | A47B 47/05 | 312/107 |
| 2014/0084765 | A1 * | 3/2014 | Riley | A47C 4/021 | 312/258 |
| 2016/0058171 | A1 * | 3/2016 | Moyer | A47B 3/0803 | 29/428 |

* cited by examiner

MODULAR TUBE FRAME CABINET SYSTEM

CROSS-REFERENCE TO RELATED APPLICATION

The present application claims the priority benefit of U.S. Provisional Patent App. No. 62/958,447 filed on Jan. 8, 2020, the entire disclosure of which is incorporated herein by reference.

BACKGROUND

Cabinet systems are used residentially and commercially for a variety of purposes such as storing items, displaying items, selling items, as work surfaces, etc. Cabinet systems can be open or enclosed, and may include features such as shelves, drawers, doors, countertops, etc. Many traditional retail cabinet systems are constructed of wood or particleboard composites with plastic laminate surfaces. Other cabinet systems are constructed from bent metal that is held together via fasteners.

SUMMARY

An illustrative cabinet system includes a first vertical end support and a second vertical end support. The first vertical end support and the second vertical end support are each formed from a plurality of metal tubes. The cabinet system also includes a plurality of horizontal stringers that extend between the first vertical end support and the second vertical end support. One or more of the horizontal stringers is configured to support a countertop. The cabinet system further includes a plurality of lateral stringers that extend between the first vertical end support and the second vertical end support. At least one of the lateral stringers is a toe kick.

An illustrative method of forming a cabinet system includes forming a first vertical end support and a second vertical end support from a plurality of metal tubes. The method also includes forming a plurality of horizontal stringers that extend between the first vertical end support and the second vertical end support, where one or more of the horizontal stringers is configured to support a countertop. The method further includes forming a plurality of lateral stringers that extend between the first vertical end support and the second vertical end support. At least one of the lateral stringers is formed as a toe kick.

Other principal features and advantages of the invention will become apparent to those skilled in the art upon review of the following drawings, the detailed description, and the appended claims.

BRIEF DESCRIPTION OF THE DRAWINGS

Illustrative embodiments will hereafter be described with reference to the accompanying drawings, wherein like numerals denote like elements. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1A:
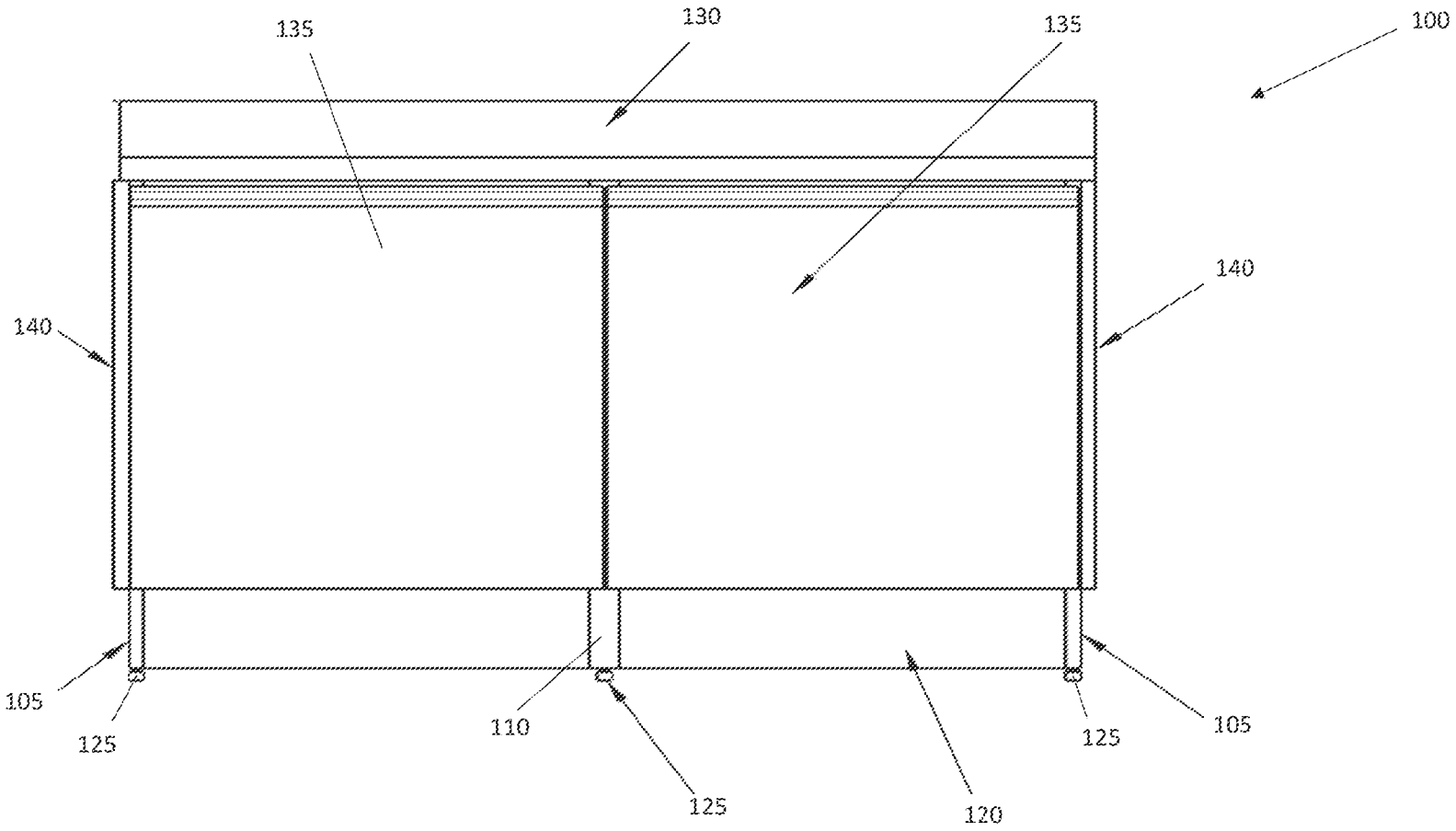
FIG. 1A is a front elevation view of a modular tube frame cabinet system (or system) in accordance with an illustrative embodiment.

Many traditional retail cabinet systems are constructed of wood and/or particle board composites with plastic laminate surfaces. These surfaces do not hold up well when exposed to moisture and heavy use. Specifically, wood and composite cabinet systems are subject to deforming, warping, breaking, and developing mold from moisture. Wood-based cabinet systems are also time-consuming to design and build for custom layouts, and are costly to ship due to their weight and dimensional cube. Other traditional cabinet systems are made from bent metal. Such systems are usually more durable than their wood/composite counterparts, but are complex to assemble and much more costly to manufacture and build. Metal cabinets systems are limited in design and may not offer customized solution flexibility in a timely fashion. In today's competitive retail environment, there exists a marketplace need for a simple-to-assemble, structurally sound, durable, and affordable cabinet system.

Described herein is a modular tube frame cabinet system that has high structural integrity and durability. The proposed cabinet system is also easy to assemble and offers purchasers the flexibility to customize in a value engineered format. The modular tube frame cabinet system is also unique in that it provides an open architecture underneath the cabinets for optimum air flow and mechanical access for equipment operation and electrical/plumbing connections that may used in conjunction with the system.

The proposed modular tube frame cabinet system is also advantageous because it can be shipped in a very compressed form and assembled on site with several key components that are used multiple times for maximum simplicity and ease of assembly. The proposed system can also be finished with a variety of low cost or higher end finish materials to match any style or décor to fit the purchaser's design needs. Additionally, the proposed system is engineered to directly transfer the weight of the items on the counter/shelves of the system to the floor for optimal strength and stability with minimal material deflection.

The proposed system includes a support structure that allows for the simplified assembly of structurally sound cabinet components that form the modular tube frame cabinet system. In an illustrative embodiment, the support structure includes vertical end supports, horizontal stringers, and lateral stringers (one or more of which may be used as a toe kick). The support structure may also include one or more vertical center supports. These components can be attached together to create a frame system that supports various counter tops, hinged doors, a bottom shelf, one or more additional shelves, brackets, etc. Vertical end and center supports can be constructed of welded metal tube frames which have legs with levelers that may be adjustable to allow height variation of the cabinet system. First and second sets of structural horizontal stringers are used to tie the vertical end/center supports together to create the cabinet box frame. These horizontal stringers, when assembled to the vertical supports, also create a finished face frame for the front of the system.

The metal frame support structure of the cabinet system can be designed to be exposed or hidden, and can be powder-coated in a variety of durable finish colors. Doors can be mounted to hinges that are attached to the vertical tube frames (i.e., either the vertical end or center supports). The horizontal stringers can be produced in a variety of lengths to determine the optimal combination of standard or customized cabinet sizes. In an illustrative embodiment, these components of the support structure can be welded powder-coated steel tube or sheet material which is laser cut with predrilled holes for easy assembly with sheet metal screws. In alternative embodiments, a different type of metal can be used, such as aluminum.

In another illustrative embodiment, bracket extensions can be attached to the back (or front) of the support structure frames to extend the depth of the counter tops. The bracket extensions can also be used to create a chase area on the back side of the cabinets to allow for electrical and/or plumbing connections along the back wall to which the cabinets would connect. In one embodiment, the bracket extensions can be mounted in a plurality of orientations to control the amount of depth added to the countertop. For example, in one embodiment, a first orientation of the bracket extension can result in a 6 inch extension and a second orientation of the bracket extension can result in a 12 inch extension. Alternatively, different extension lengths may be used, such as 3 inches, 9 inches, 18 inches, etc. In one embodiment, the vertical end/center supports have integral leg assemblies that include Grater clips and levelers that can be used to level the counter system on uneven floors. Alternatively or additionally, casters may be used to make the cabinet mobile. These components are described in more detail below.

The proposed support structure has pre-drilled holes which receive fasteners that can be used to secure door hinges, finished end panels, countertops (variable sizes), accessories, etc. for quick and easy installation. These finished panels can be made of wood laminate, polyvinyl chloride (PVC) laminate, or metal materials in custom designs and finishes to match the décor of the environment in which they are being placed. A floor panel (various sizes) is designed to drop in place and can easily be removed for cleaning or mechanical access. This floor panel material can be made of high-density polyethylene (HDPE), other polymer, wood, or metal. Plastic panels can be beneficial because they are mold and water resistant and lightweight. This same panel can also be used as an optional shelf that rests on clips attached at variable positions in pre-drilled holes on the vertical end/center supports. Countertops of various materials can be mounted to the horizontal stringer members.

There are also optional inserts that can be used on the front face frame of the cabinet such as cup dispensers or condiment dispensers for use in various foodservice or convenience store environments. A variety of connectors can be used to connect the frame system together to create different angles and shapes such as 45 and 90 degree inside and outside corners to fit a desired floor plan. For example, the cabinet modules can be positioned in a variety of ways to create the overall layout of the system in a lineal run or as an island in many combinations. The vertical end support and vertical center support are tube frame structures that are precisely sized to maintain overall nominal cabinet lengths when used in various combinations. A variety of filler panels can also be used to enclose open sections of the framed system by connecting panels to the vertical end and center supports as needed. The cabinets can also be used to connect with a vertical post assembly and canopy structure to form a kiosk or cart (with casters) which can be connected in combinations to create a food court or other attraction.

Figure 1B:
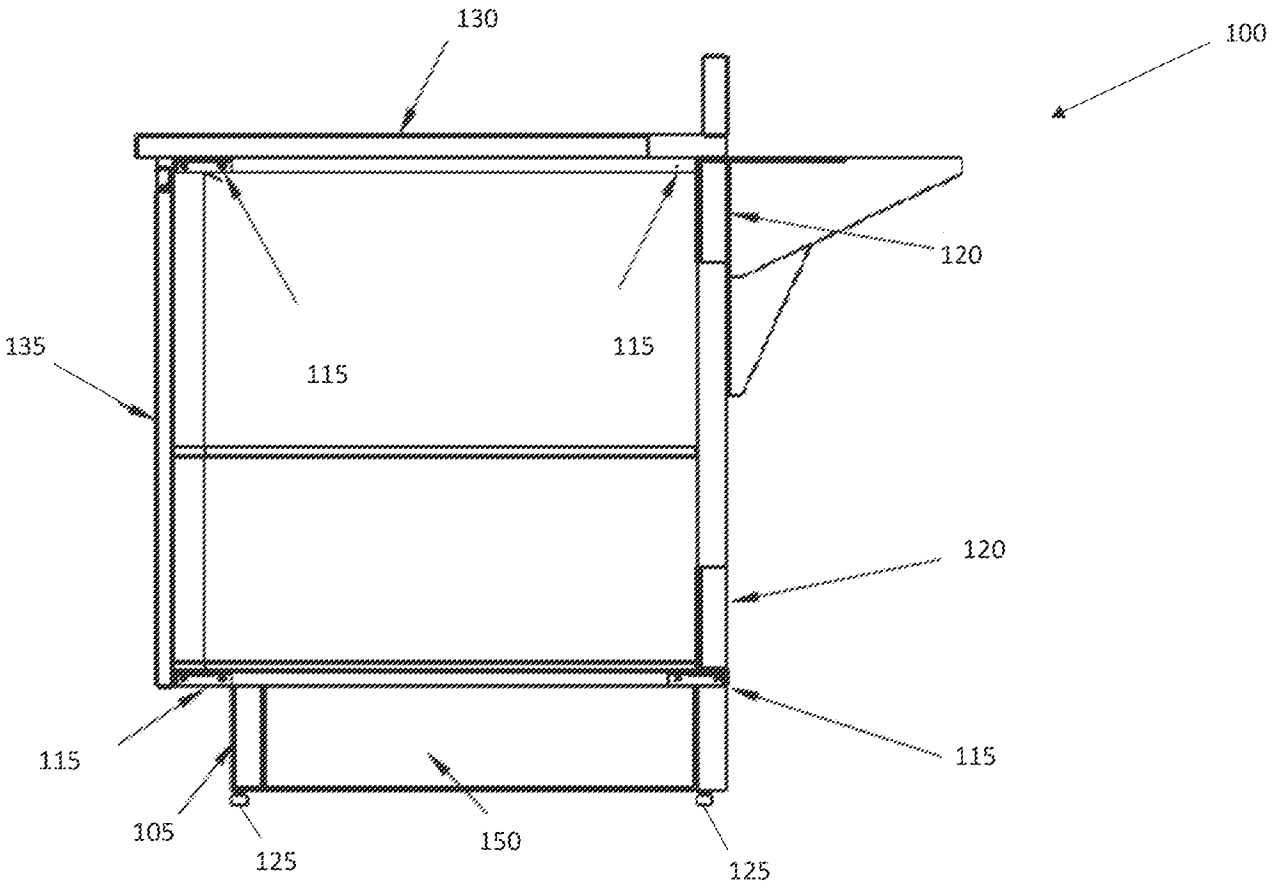
FIG. 1B is a cross-sectional side view of the modular tube frame cabinet system in accordance with an illustrative embodiment.
Figure 1C:
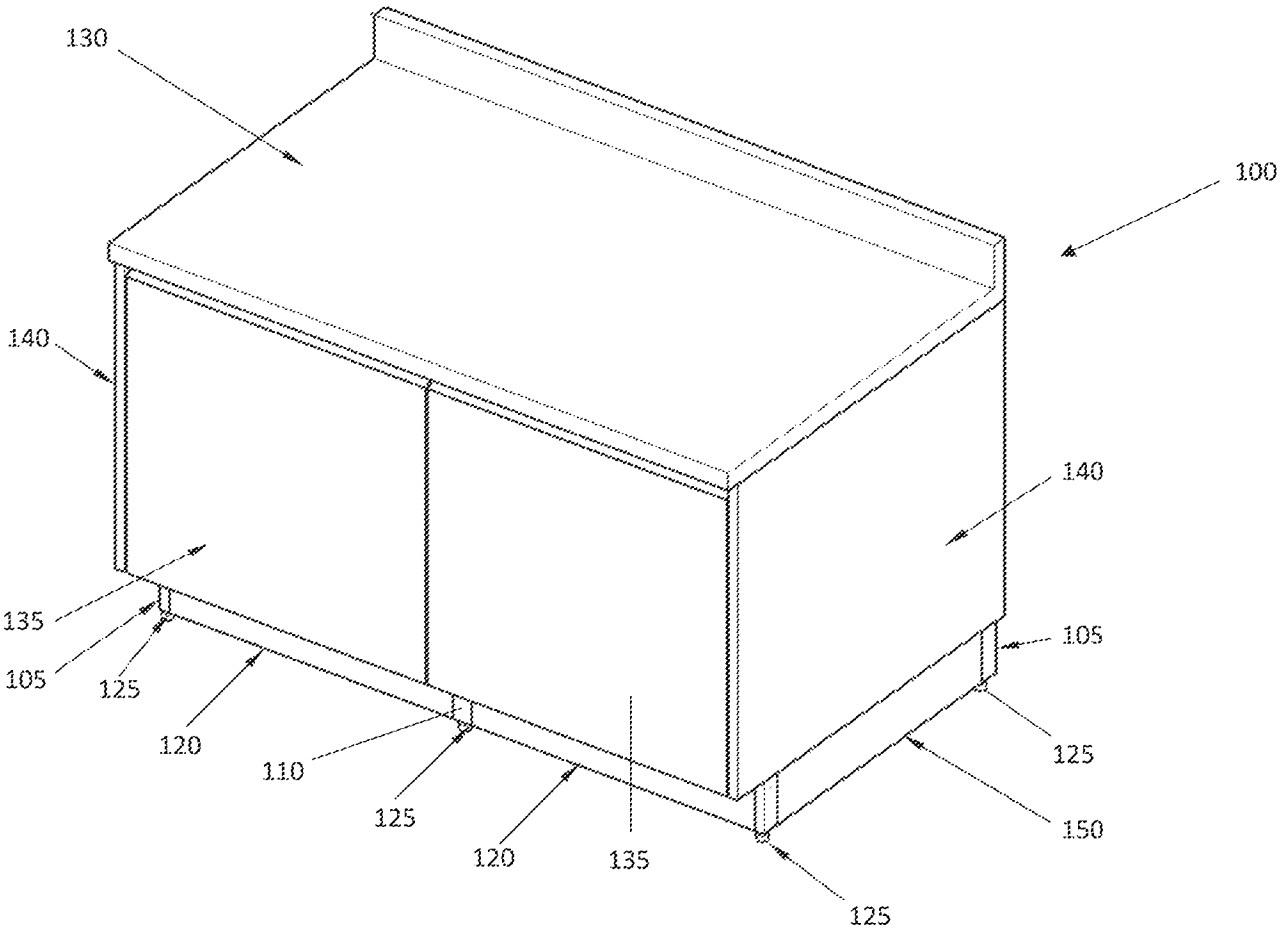
FIG. 1C is a front perspective view of the modular tube frame cabinet system in accordance with an illustrative embodiment.
Figure 1D:
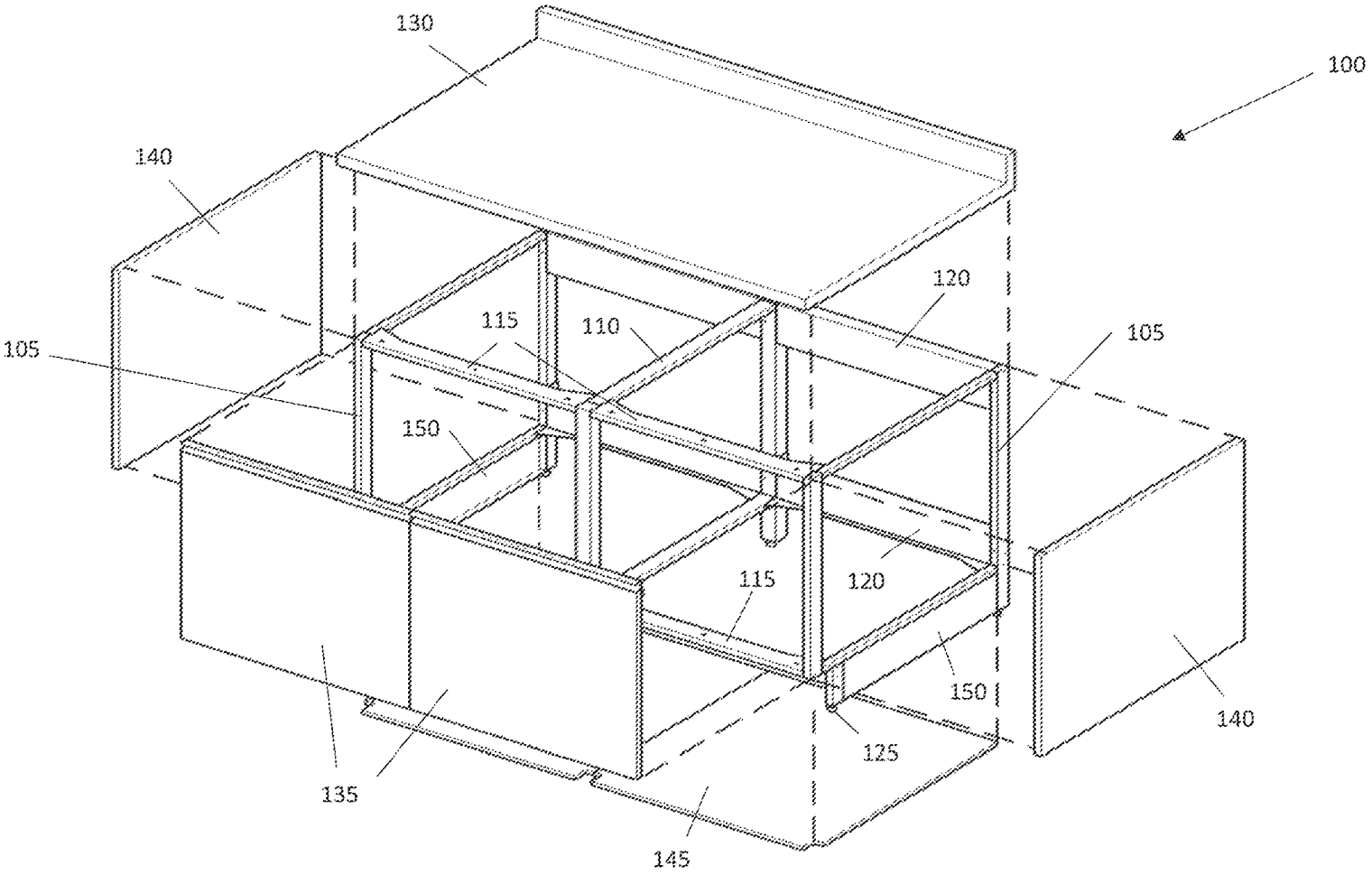
FIG. 1D is an exploded view of the modular tube frame cabinet system in accordance with an illustrative embodiment.

FIG. 1A is a front elevation view of a modular tube frame cabinet system (or system) 100 in accordance with an illustrative embodiment. FIG. 1B is a cross-sectional side view of the modular tube frame cabinet system 100 in accordance with an illustrative embodiment. FIG. 1C is a front perspective view of the modular tube frame cabinet system 100 in accordance with an illustrative embodiment. FIG. 1D is an exploded view of the modular tube frame cabinet system 100 in accordance with an illustrative embodiment.

The system 100 includes a support structure with various attached panels and components. The support structure, which is described in more detail with reference to FIG. 2, includes vertical end supports 105, a vertical center support 110, horizontal stringers 115, and lateral stringers 120. Mounted to the bottoms of the vertical end supports 105 and the vertical center support 110 are levelers 125 that can be used to even out the system 100 if it is placed on an uneven surface. Alternatively, instead of levelers, the system 100 may use casters such that the system 100 can easily be moved from one location to another. The casters can either be statically mounted or adjustable in nature such that they are also able to perform a leveling function for the system 100. In another alternative embodiment, levelers and casters may not be used.

Mounted to the support structure are a countertop 130, front panels 135, end panels 140, a bottom panel (or bottom shelf) 145, and end panel toe kicks 150. In alternative embodiments, fewer, additional, and/or different components may be mounted to the support structure of the system 100. The countertop 130 can be made from any suitable material such as metal, wood, plastic, stone, etc. In one embodiment, the countertop 130 can be secured by fasteners that extend through a bottom side of the upper horizontal stringers 115 and into a bottom surface of the countertop 130. Fasteners can also be placed through the upper lateral stringers 120 into the countertop 130 and/or through the top bars of the vertical end supports 105 and vertical center support 110 and into the countertop 130.

Similarly, the end panels 140 can be secured to the vertical end supports 105 via fasteners (e.g., metal screws) that extend through pre-drilled holes in the vertical end supports 105. The end panels 140 can be made from any desired material (e.g., wood, plastic, metal, etc.), and can be used to help match the system 100 to the décor of the surroundings. The end panels 140 can be 0.75 inches thick in one embodiment. In another embodiment, the front panels 135 can be doors that are secured to the support frame via hinges mounted to the front faces of the vertical end supports 105. In such an embodiment, the hinges can be mounted using fasteners and pre-drilled holes in the vertical end supports 105 (or other component to which the hinges are mounted). Alternatively, the front panels may be mounted directly to the support structure without using hinges such that the front panels 135 do not move relative to the support structure and act only to enclose the support structure. The front panels 135 can also be made from any desired material such as wood, plastic, metal, etc. The front panels 135 can be 0.75 inches thick in one embodiment. Additionally, any of the panels can also include text, symbols, advertisements, prices, color patterns, coatings, etc.

The bottom panel 145 can be mounted onto the lower sets of horizontal stringers 115 and/or lateral stringers 120. As shown, a front-facing side of the bottom panel 145 includes notches such that the bottom panel 145 is able fit around the front vertical bars of the vertical end supports 105 and the vertical center support 110. The end panel toe kicks 150 can mount to the bottom (horizontal) bars of the vertical end supports 105. The end panel toe kicks 150 can be used for aesthetic purposes and also to keep items from rolling under or getting stuck under the system 100.

Figure 2A:
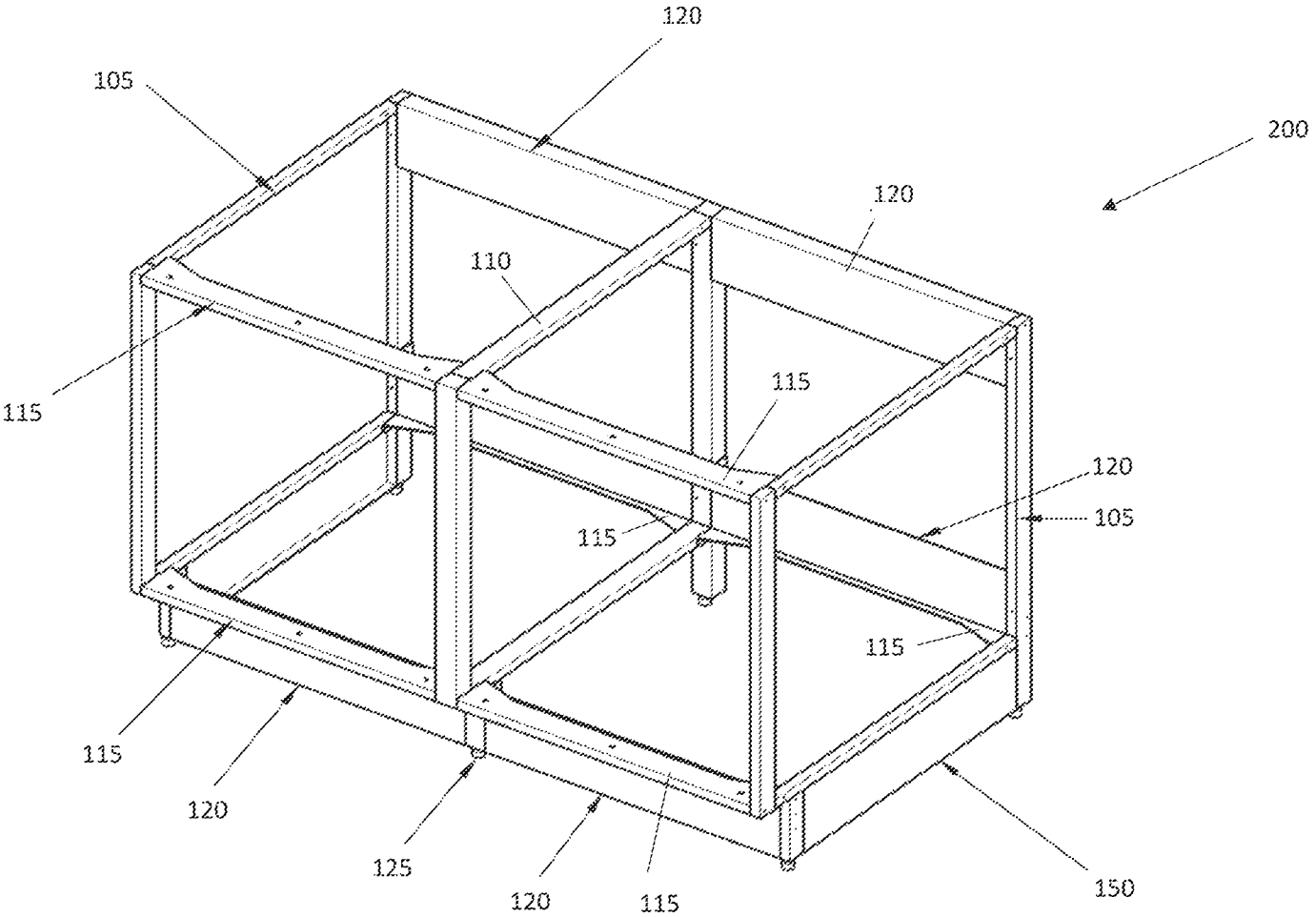
FIG. 2A depicts an assembled view of a support structure in accordance with an illustrative embodiment.
Figure 2B:
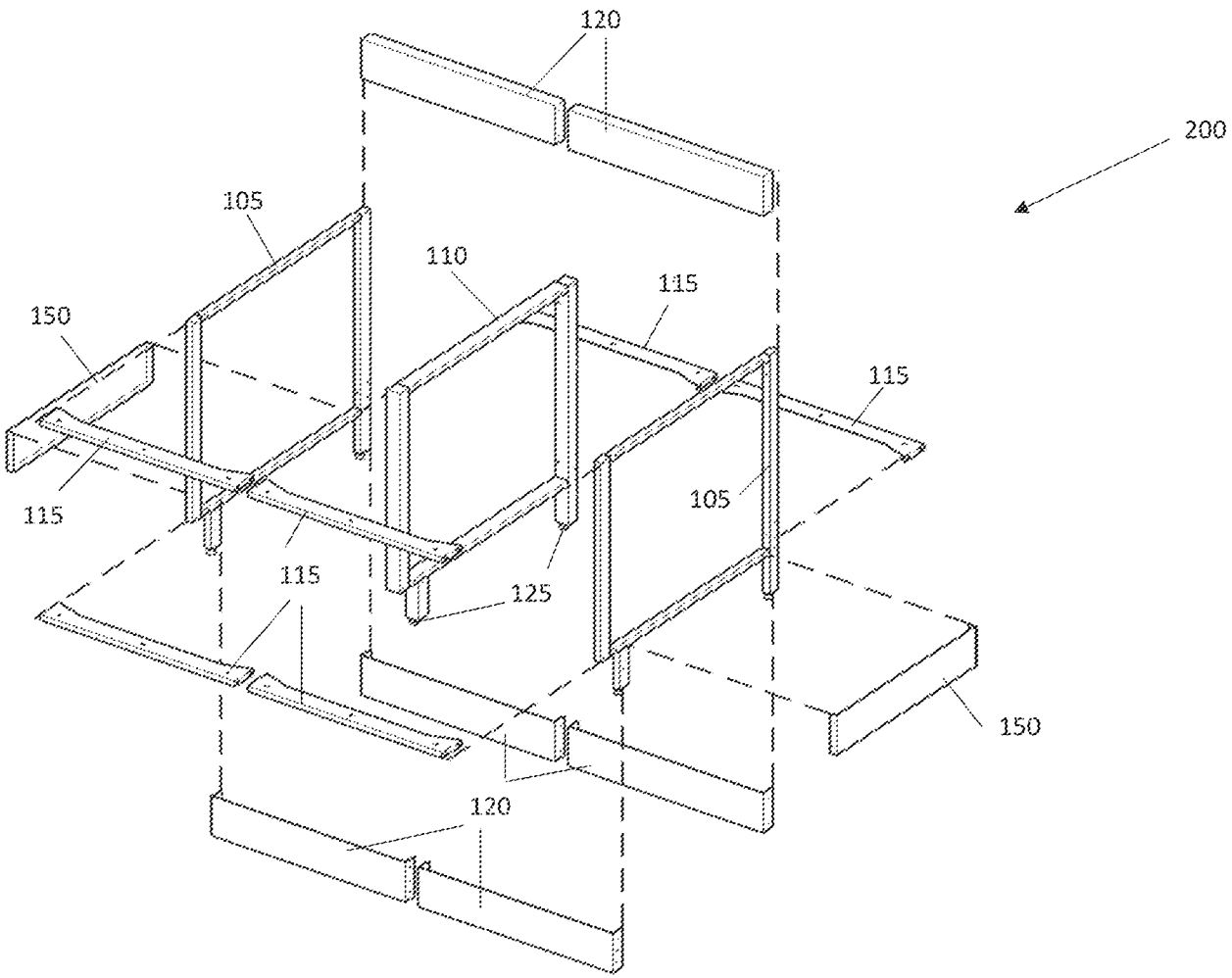
FIG. 2B depicts an exploded view of the support structure in accordance with an illustrative embodiment.

FIG. 2A depicts an assembled view of a support structure 200 in accordance with an illustrative embodiment. FIG. 2B depicts an exploded view of the support structure 200 in accordance with an illustrative embodiment. As shown, the support structure 200 includes a pair of the vertical end supports 105, the vertical center support 110, the horizontal stringers 115, and the lateral stringers 120. The support structure 200 also includes the levelers 125 mounted to the bottoms of the vertical end supports 105 and the vertical center support 110, and the end panel toe kicks 150. Alternatively, the support structure 200 may not include the levelers 125 and/or end panel toe kicks 150.

In an illustrative embodiment, the end panel toe kicks 150 are used to fill the bottom space between the legs near the floor on the vertical end support. The end panel toe kicks can be built from 16 gauge steel, with metal edges bent on three sides to provide a finished aesthetic to an exposed end condition. A 0.75 inch depth of the three sidewalls can be used to match the depth of the vertical end support (discussed in more detail below) in one embodiment. The entire component can be powder-coated black, and can include pre-drilled screw holes for assembly. Alternatively different dimensions, materials, sizes, and/or coatings may be used.

Figure 3A:
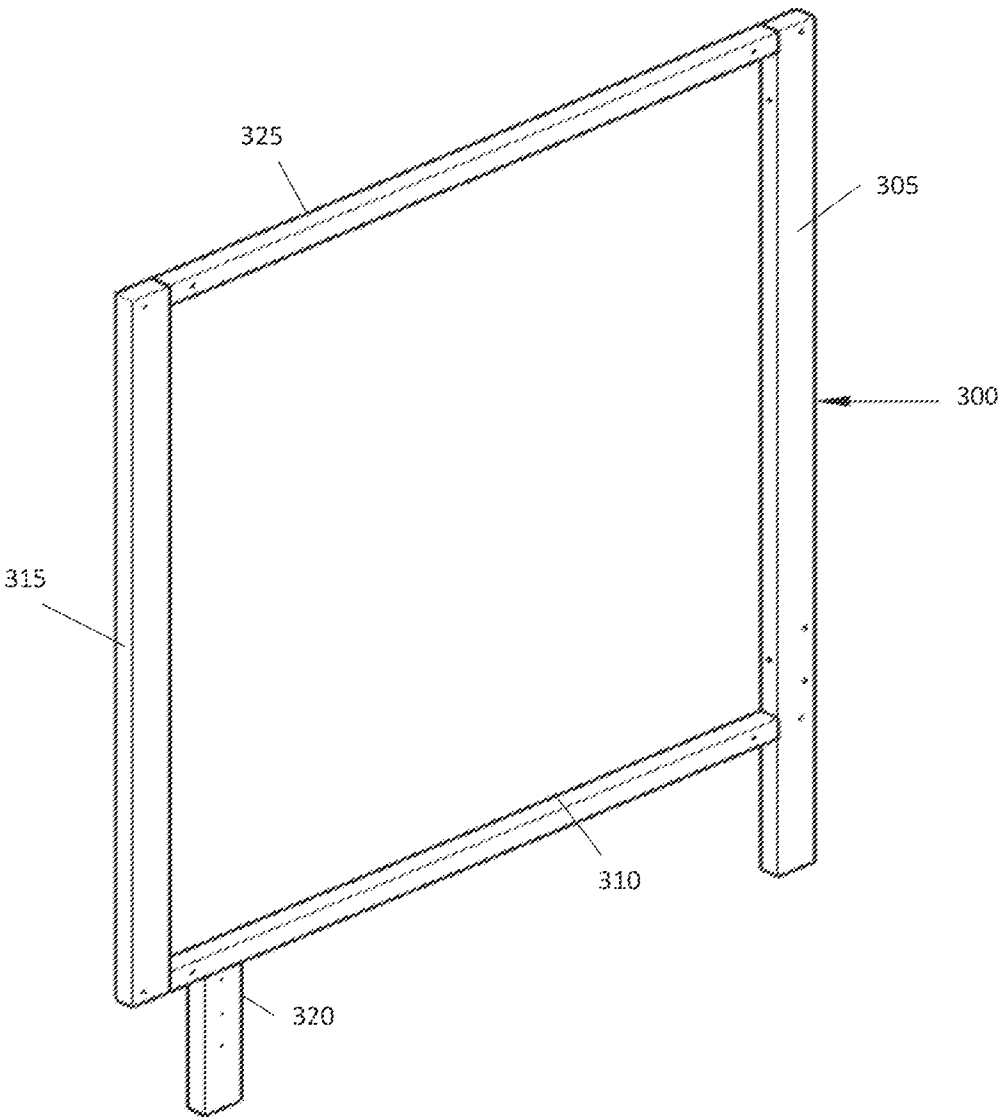
FIG. 3A depicts a vertical end support in accordance with an illustrative embodiment.
Figure 3B:
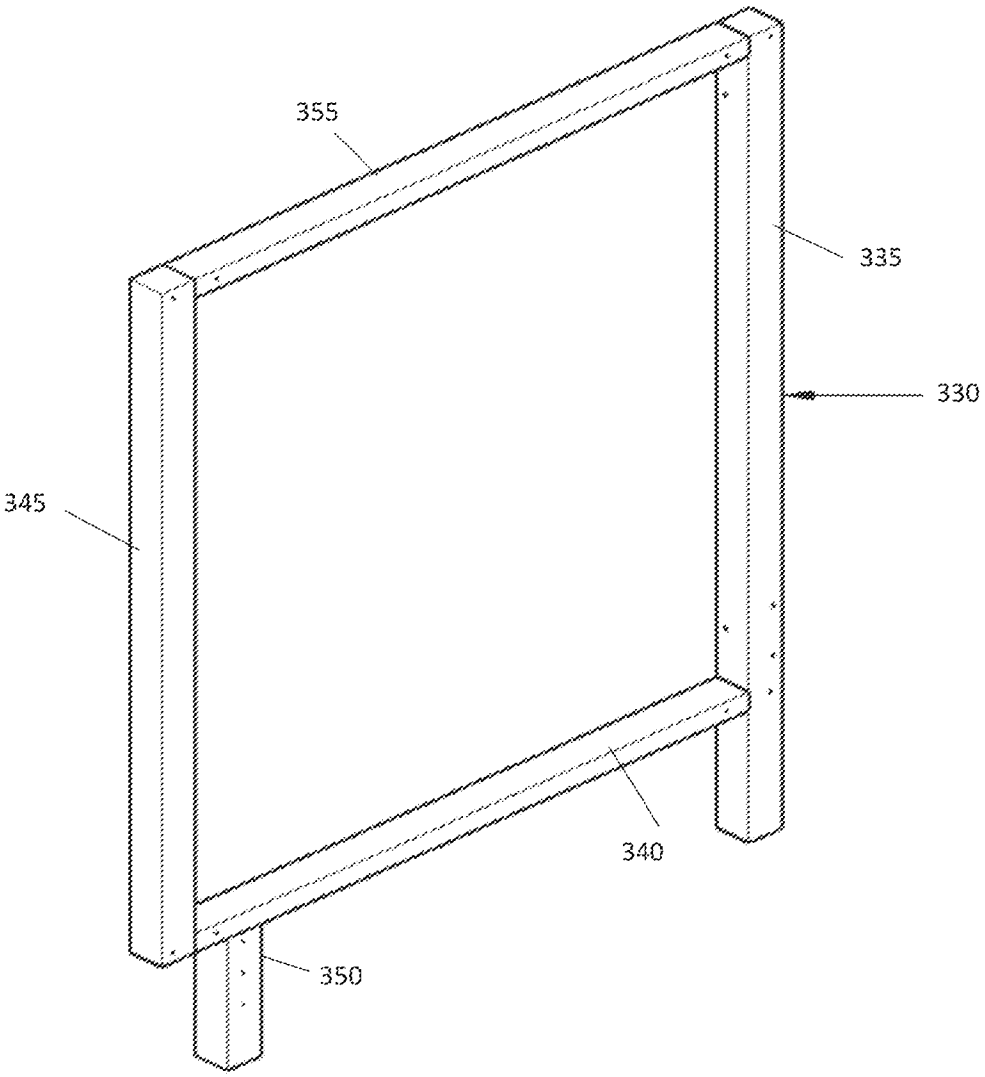
FIG. 3B depicts a vertical center support in accordance with an illustrative embodiment.
Figure 3C:
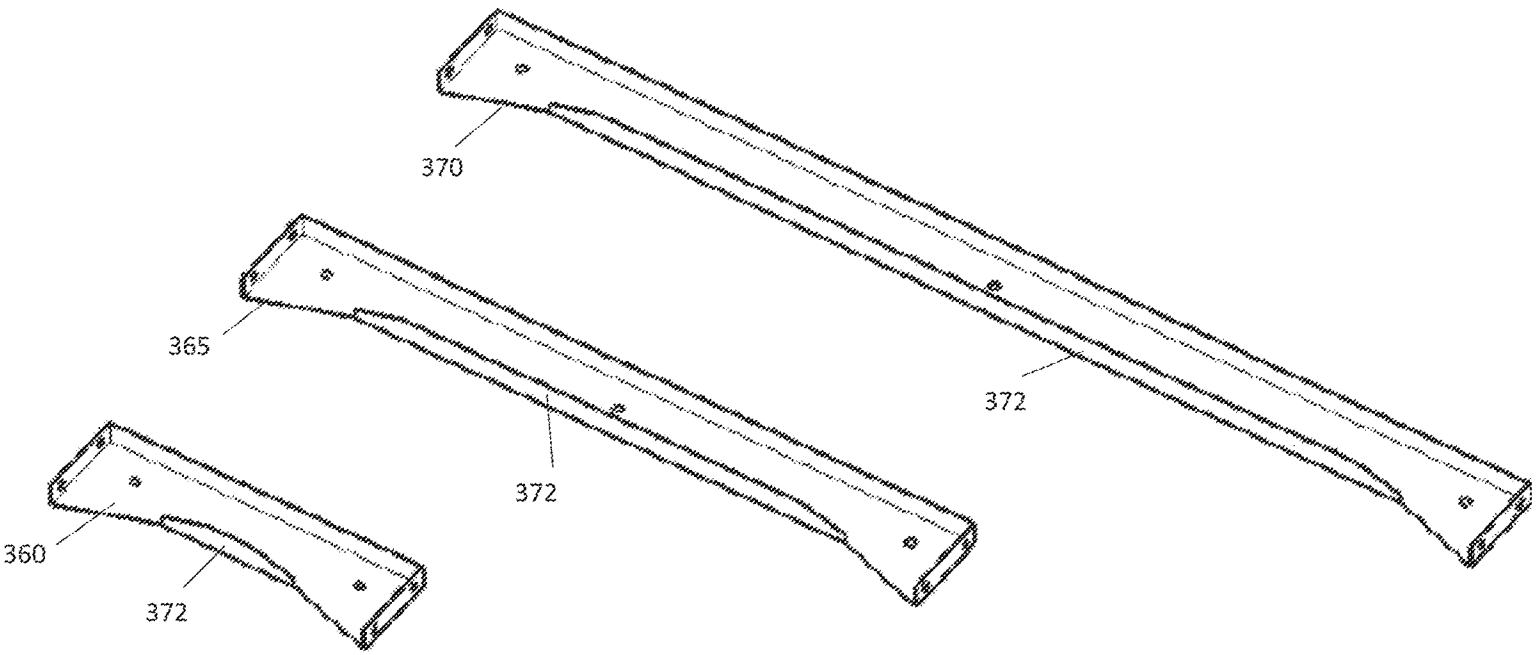
FIG. 3C depicts horizontal stringers of various sizes in accordance with an illustrative embodiment.
Figure 3D:
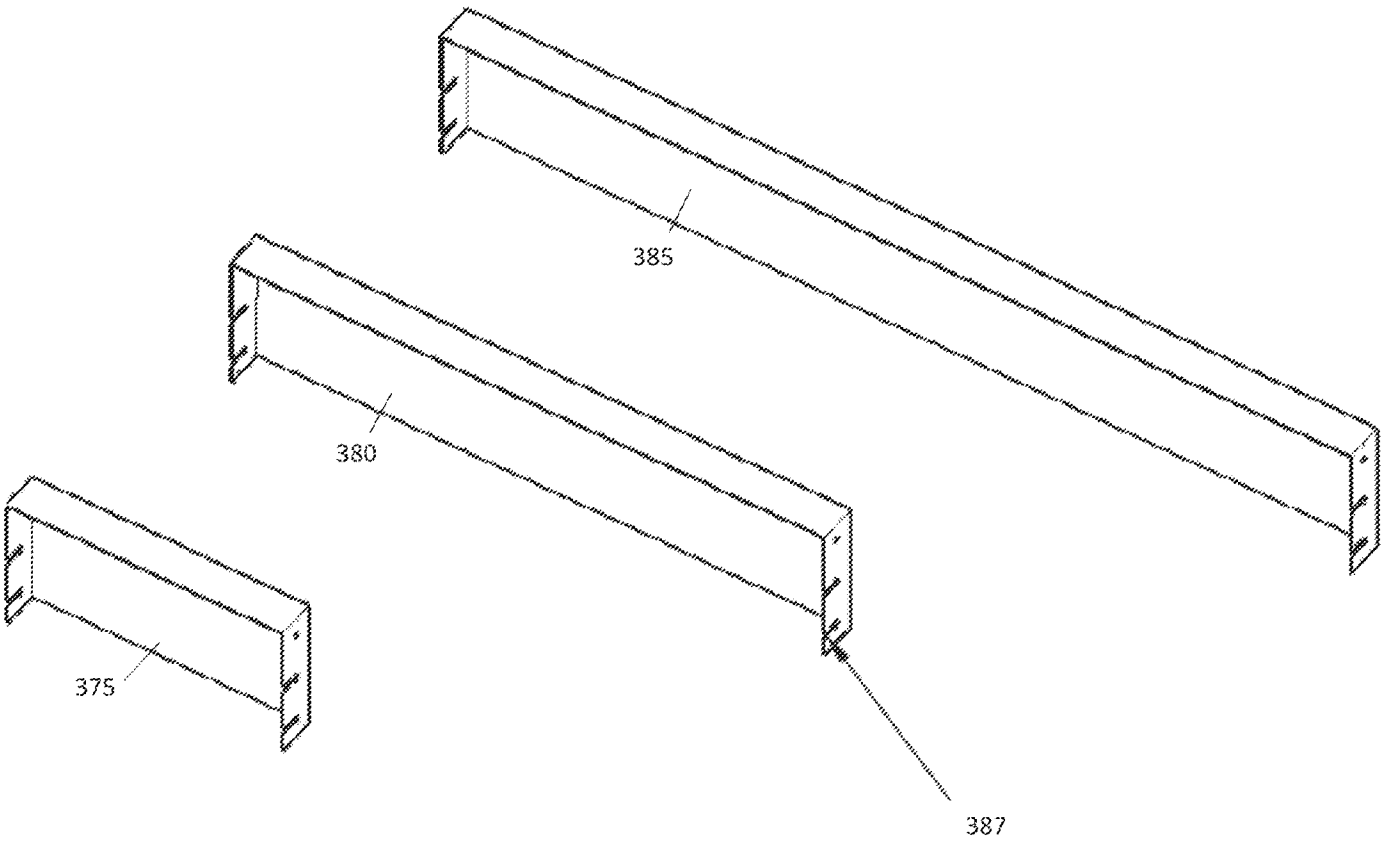
FIG. 3D depicts lateral stringers of various sizes in accordance with an illustrative embodiment.
Figure 3E:
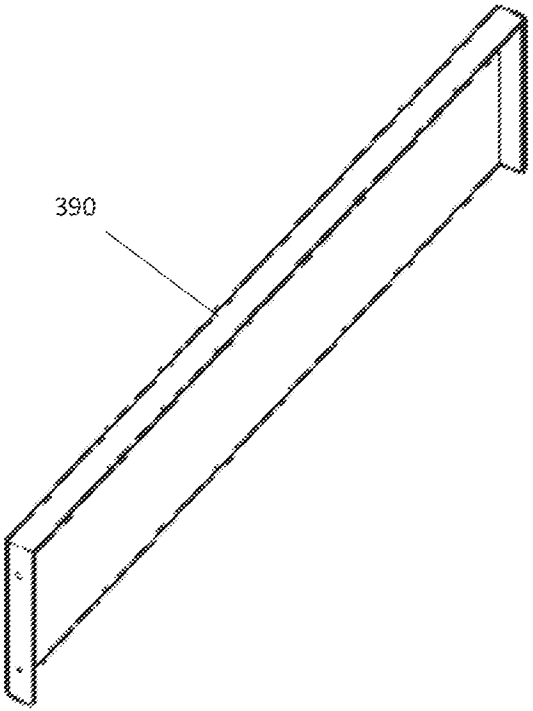
FIG. 3E depicts a side toe kick in accordance with an illustrative embodiment.

FIGS. 3A-3E depict the primary components of support structure that is used to form the proposed system. Specifically, FIG. 3A depicts a vertical end support 300 in accordance with an illustrative embodiment. FIG. 3B depicts a vertical center support 330 in accordance with an illustrative embodiment. FIG. 3C depicts horizontal stringers of various sizes in accordance with an illustrative embodiment. FIG. 3D depicts lateral stringers of various sizes in accordance with an illustrative embodiment. FIG. 3E depicts a side toe kick 390 in accordance with an illustrative embodiment.

Referring to FIG. 3A, the vertical end support 300 includes a rear vertical bar 305 that extends from the ground surface to the top of the support structure. A bottom horizontal bar 310 extends between the rear vertical bar 305 and a front vertical bar 315. The bottom horizontal bar 310 is mounted to the rear vertical bar 305 such that there is a gap between the ground surface and the bottom of the bottom horizontal bar 310. This gap is used to raise the bottom surface of the system up off of the ground surface, and also to facilitate use of a front toe kick that is set back from the front surface of the system. The gap can be any desired distance such as 3 inches, 4 inches, 6 inches, etc. A vertical leg 320 is mounted to the bottom horizontal bar 310 with a setback from the front surface of the front vertical bar 315 to accommodate the front toe kick (if included). The setback can be any desired distance such as 3 inches, 4 inches, 6 inches, etc. A top horizontal bar 325 is mounted in between the rear vertical bar 305 and the front vertical bar 315.

In an illustrative embodiment, the components of the vertical end support 300 are formed from metal tubes that have a square or rectangular cross section. Alternatively, a different type of cross-sectional shape may be used. For example, the rear vertical bar 305, the front vertical bar 315, and the vertical leg 320 can have cross-sectional dimensions of 0.75 inches by 1.5 inches, and the bottom horizontal bar 310 and the top horizontal bar 325 can have cross-sectional dimensions of 0.75 inches by 0.75 inches. Alternatively, other sizes may be used. The vertical end support 300 can be made from any type of suitable metal such as steel, stainless steel, aluminum, etc. In one embodiment, 16 gauge steel is used. The metal tubes can be formed via welding, molding, extrusion, and/or any other manufacturing processes known in the art. The components (i.e., metal tubes) of the vertical end support 300 can be welded to one another in an illustrative embodiment. Alternatively, the components can be connected to one another via fasteners or using any other method.

Each of the components of the vertical end support 300 includes pre-drilled holes that are configured to receive fasteners such that other components can be added such as horizontal stringers, lateral stringers, panels, hinges, toe kicks, accessories, brackets, etc. In an illustrative embodiment, the vertical end support 300 has holes drilled equally on both sides to be used as a universal part (on either the left or right side). The entire component can be powder-coated black in some embodiments. The front face of the vertical end support has holes pre-drilled for hinges and acts as a face frame for the final assembly. The end supports (along with vertical center support) evenly distribute the structural load from the countertop through the vertical members to the floor. Also, the back of the vertical end support 300 has pre-drilled holes to support optional extension brackets, which are described in more detail below. In alternative embodiments, fewer or additional holes may be included.

Referring to FIG. 3B, it can be seen that the vertical center support 330 is similar in shape to the vertical end support 300. In some embodiments, the vertical center support 330 and the vertical end support 300 can be identical to one another. Alternatively, the vertical center support 330 and the vertical end support 300 may differ from one another in the dimensions and/or shape of the tubes used to construct them. The vertical center support 330 includes a rear vertical bar 335 that extends from the ground surface to the top of the support structure. A bottom horizontal bar 340 extends between the rear vertical bar 335 and a front vertical bar 345. The bottom horizontal bar 340 is mounted to the rear vertical bar 335 such that there is a gap between the ground surface and the bottom of the bottom horizontal bar 340. This gap can be the same as the gap used included on the vertical end support 300. A vertical leg 350 is mounted to the bottom horizontal bar 340 with a setback from the front surface of the front vertical bar 345 to accommodate the front toe kick (if included). The setback can be the same distance as that included on the vertical end support 300. A top horizontal bar 355 is mounted in between the rear vertical bar 335 and the front vertical bar 345.

Similar to the vertical end support 300, the components of the vertical center support 330 are formed from metal tubes that have a square or rectangular cross section. Alternatively, a different type of cross-sectional shape may be used. Any type of suitable metal may be used, and the tubes can be formed via welding, molding, extrusion, etc. The components (i.e., metal tubes) of the vertical center support 330 can be welded to one another in an illustrative embodiment. Alternatively, the components can be connected to one another via fasteners or using any other method. In an illustrative embodiment, the vertical center support 330 is built from 16 gauge steel tube. Alternatively, a different gauge and/or material may be used. In one embodiment, all components of the vertical center support 330 can be 1.5 inches by 1.5 inches in size to provide extra structural support.

Each of the components of the vertical center support 330 includes pre-drilled holes that are configured to receive fasteners such that other components can be added such as horizontal stringers, lateral stringers, panels, hinges, toe kicks, accessories, brackets, etc. The vertical center support 330 has holes drilled equally on both sides to that it can be used as a universal part (on either left or right sides). The entire component can be powder coated black in some embodiments. The front of the front vertical bar 345 has holes pre-drilled for hinges and act as a face frame for the final assembly. The vertical center supports (along with the vertical end supports) evenly distribute the structural load from the countertop through the vertical members to the floor. The back of the vertical center support 330 has pre-drilled holes to support optional extension brackets. In alternative embodiments, fewer or additional holes may be included.

FIG. 3C depicts a horizontal stringer 360, a horizontal stringer 365, and a horizontal stringer 370, each of which has a different length. The availability of different sizes of horizontal stringers allows the overall length of the cabinet system to be customized by the end user. For example, the horizontal stringer 360 can be used to construct sections of a cabinet system that are to have a first length (e.g., 18 inches), the horizontal stringer 365 can be used to construct sections of a cabinet system that are to have a second length (e.g., 24 inches), and the horizontal stringer 370 can be used to construct sections of a cabinet system that are to have a third length (e.g., 30 inches). These various cabinet sections of different lengths can be combined with one another in any order or configuration to allow complete customizability of the system. Additionally, while only 3 different lengths are depicted, it is to be understood that additional and/or different lengths may be used in alternative embodiments such as 12 inches, 16 inches, 20 inches, 28 inches, 36 inches, 42 inches, etc.

As shown, each of the horizontal stringers includes a flat surface with 3 sidewalls extending therefrom at a 90 degree angle to add structural integrity. The sidewalls can extend out 0.75 inches in an illustrative embodiment. End portions on the side of the flat surface that does not include a sidewall are flared (or tapered) out such that a width of the flat surface varies along its length. As also shown, each of the horizontal stringers includes a flange 372 that further increases its strength. The flange 372 is in the form of an extension that extends at an angle (e.g., 90°) from the inner edge of the stringer. As discussed, the ends of the stringer taper inward, and these tapered ends are joined by a straight section (i.e., inner edge) that includes the flange 372 mounted thereto. In an illustrative embodiment, the flange 372 is welded, molded, or otherwise attached to the inner edge of the horizontal stringer. In alternative embodiments, a different configuration may be used The horizontal stringers also include pre-drilled holes that can be used to mount them to the vertical end/center supports and to a countertop. In an illustrative embodiment, multiple horizontal stringers can be used together to provide horizontal attachment between any desired number of vertical end and center supports. The entire part can be powder coated black in one embodiment.

FIG. 3D depicts a lateral stringer 375, a lateral stringer 380, and a lateral stringer 385, each of which has a different length. In an illustrative embodiment, each of the lateral stringer lengths can correspond to a horizontal stringer length. For example, the lateral stringers 375 may be used to form a cabinet section that includes the horizontal stringers 360 such that a short cabinet section is formed. Similarly, the lateral stringers 380 can be paired with the horizontal stringers 365 to form a cabinet section of medium length, and so on. As with the horizontal stringers, while only 3 different lengths are depicted, it is to be understood that additional and/or different lengths of the lateral stringers may be used in alternative embodiments.

As shown, each of the lateral stringers includes a flat surface with 3 sidewalls extending therefrom at a 90 degree angle to add structural support. The sidewalls can extend out 0.75 inches in an illustrative embodiment. Alternatively, a different length may be used. The side of the flat surface that does not include a sidewall is straight such that a width of the flat surface remains the same along its length. The lateral stringers can be made from 16 gauge steel in one embodiment. The lateral stringers also include pre-drilled holes that can be used to mount them to the vertical end/center supports and/or to mount panels and other accessories to the system. In some embodiments, the lateral stringers also include one or more keyhole openings 387 that allow for attachment and removal as a toe kick panel, as discussed in more detail below. The lateral stringers can have a height that is able to fill the entire space of the toe kick, and the same lateral stringers can also be used on the back of the vertical end/center supports to provide lateral strength. Multiple horizontal lateral stringers (e.g., three) can be used together to provide horizontal attachment between the desired amount of vertical end and center supports. The entire component can be powder coated black in one embodiment.

FIG. 3E depicts a side toe kick 390 in accordance with an illustrative embodiment. The side toe kick 390, which can include pre-drilled holes, is designed to mount inside of the vertical end supports of the system. As shown, the toe kick 390 includes a flat surface with 3 sidewalls extending therefrom at a 90 degree angle to add structural support. The sidewalls can extend out 0.75 inches in an illustrative embodiment. Alternatively, a different length may be used.

Figure 4B:
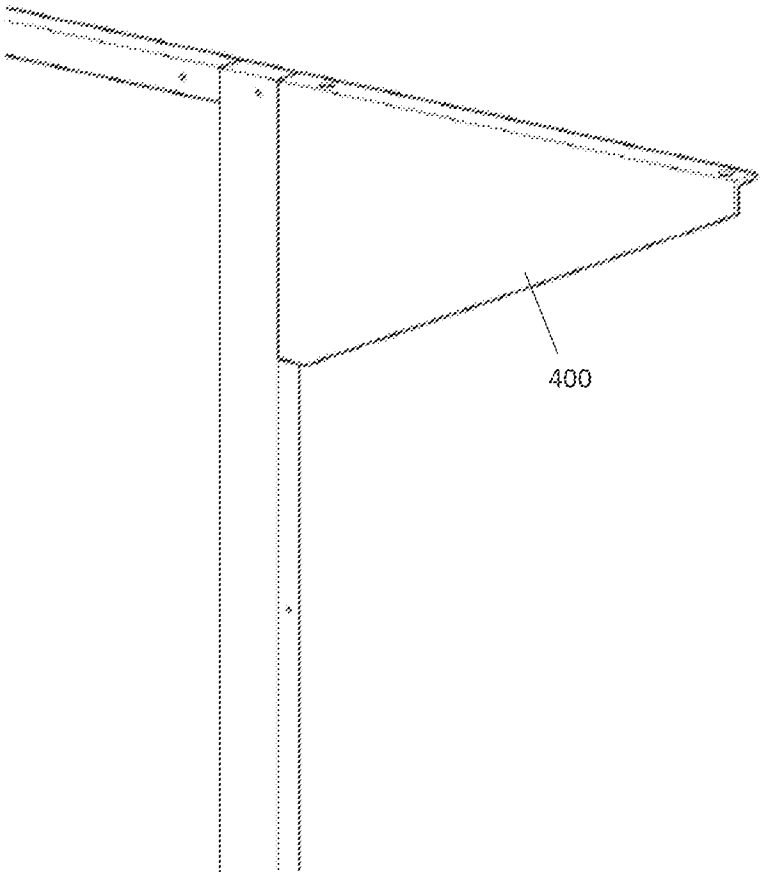
FIG. 4B depicts the extension bracket mounted to the system in a horizontal orientation in accordance with an illustrative embodiment.
Figure 4A:
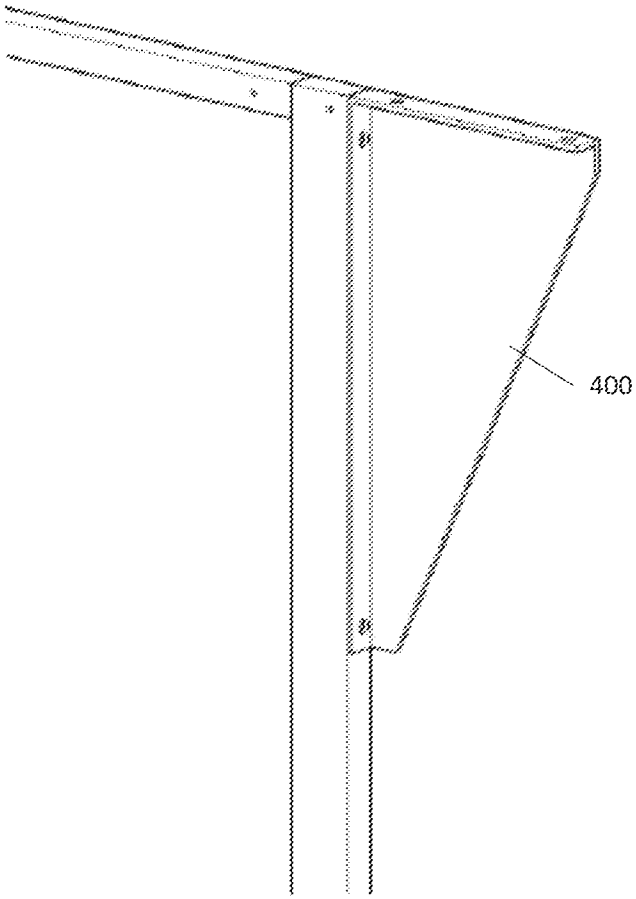
FIG. 4A depicts an extension bracket mounted to the system in a vertical orientation in accordance with an illustrative embodiment.

FIG. 4A depicts an extension bracket 400 mounted to the system in a vertical orientation in accordance with an illustrative embodiment. FIG. 4B depicts the extension bracket 400 mounted to the system in a horizontal orientation in accordance with an illustrative embodiment. In an illustrative embodiment, the extension bracket 400 is mounted to the back side of the vertical end and center supports to allow for larger counter-top depths. The resulting increase in countertop depth can be used to accommodate electoral wiring, plumbing, etc. without interfering with the regular interior of the cabinet system. In the depicted embodiment, the extension bracket 400 is 6 inches by 12 inches and can be mounted vertically (FIG. 4A) or horizontally (FIG. 4B) to extend the countertop by six inches or twelve inches, respectively. Alternatively, different dimensions can be used for either of the orientations, such as 3 inches, 9 inches, 16 inches, 18 inches, etc. In another alternative embodiment, the extension brackets can be mounted to the front of the cabinet system to extend the countertop outward past the front of the cabinet by a desired distance. The extension bracket 400 can be built from 16 gauge steel in one embodiment to form the right triangle. Sidewalls on the two legs of the right triangle can be 0.75 inches deep, and can include holes that form connection points to the vertical center or end supports. Alternatively, different materials and/or dimensions may be used.

Figure 4C:
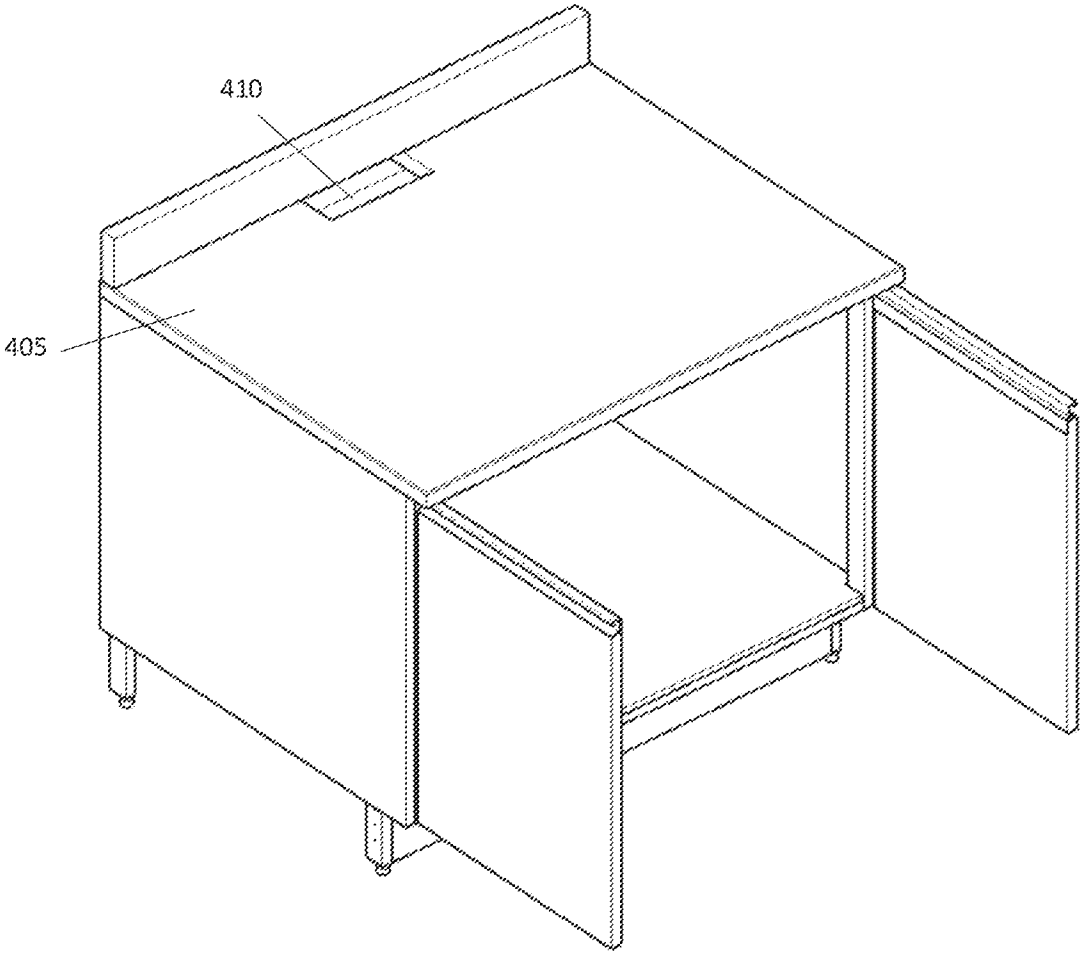
FIG. 4C depicts a cabinet system that includes an extension bracket (not visible) to allow for an extended countertop in accordance with an illustrative embodiment.

FIG. 4C depicts a cabinet system that includes an extension bracket (not visible) to allow for an extended countertop 405 in accordance with an illustrative embodiment. An extension bracket is mounted to the rear side of each of the vertical end supports to accommodate the extended countertop 405. As shown, the extended countertop 405 includes an opening 410 through which electrical lines, plumbing, etc. can be accessed by the user. The opening 410 is in the portion of the extended countertop 405 that is supported by the extension brackets.

Figure 5:
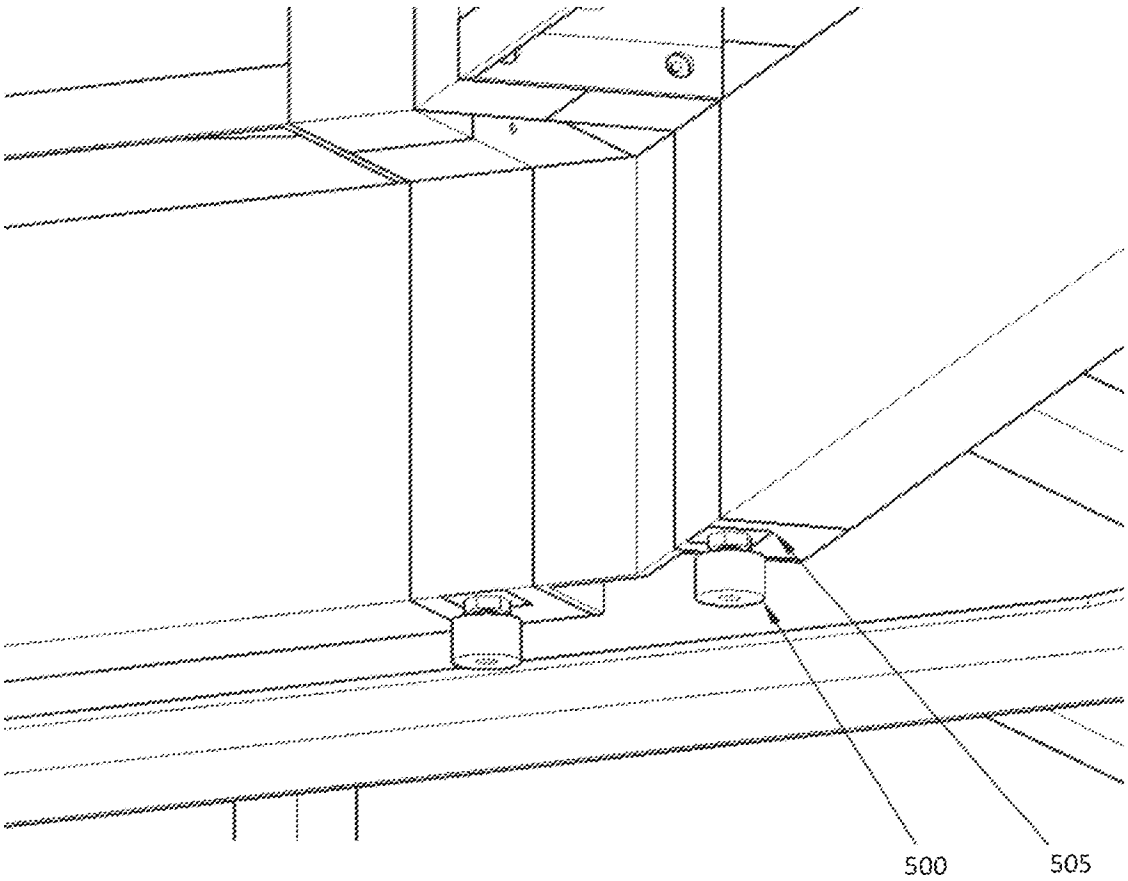
FIG. 5 is a close-up partial view of the system depicting a leveler in accordance with an illustrative embodiment.

FIG. 5 is a close-up partial view of the system depicting a leveler 500 in accordance with an illustrative embodiment. The leveler 500 is secured to the bottom of a vertical end/center support via a Grater clip 505. In one embodiment, standard Grater clips (e.g., 5/16 inch×18 thread count) can be used along with (e.g., 5/16 inch×18 thread count) levelers having a 0.75 inch rubber foot to protect the ground surface. Alternatively, any other sizes may be used. In another alternative embodiment, a different method of securing the leveler 500 may be used. The leveler 500 can be used in conjunction with other levelers to help keep the system level on uneven surfaces such as broken concrete, grass, etc. Alternatively, casters or other roller systems may be used to provide mobility to the system.

Figure 6:
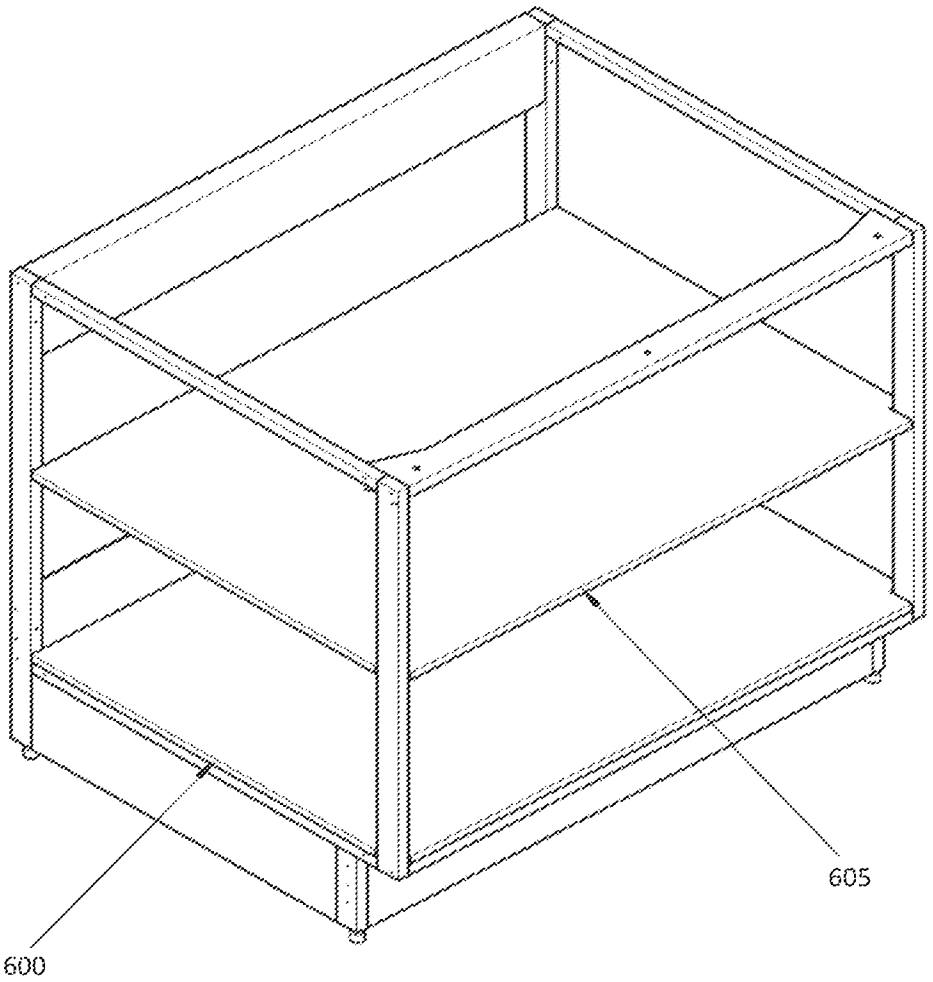
FIG. 6 depicts a cabinet system with a first shelf and a second shelf in accordance with an illustrative embodiment.

The proposed systems can also be used for storage, and can include any number of shelves on the interior to accommodate items to be stored. FIG. 6 depicts a cabinet system with a first shelf 600 and a second shelf 605 in accordance with an illustrative embodiment. The first shelf 600 (or bottom panel) and the second shelf 605 each include notches to accommodate the front vertical bars of the vertical end supports. In embodiments in which a vertical center support is present, the first and second shelves can also include a central notch on the front surface to accommodate the front vertical bar of the vertical center support. The first shelf 600 is supported by the lower horizontal stringers and the bottom horizontal bars of the vertical end supports. In an illustrative embodiment, the second shelf 605 is supported by shelf clips that mount into predrilled holes of the front/rear vertical bars of the vertical end supports (and vertical center support when present). The shelf clips can be positioned at a plurality of different locations along the lengths of the front/rear vertical bars of the vertical supports such that the second shelf 605 can be positioned at a plurality of different heights. As such, additional shelves can readily be added above and/or below the second shelf 605 by mounting additional shelf clips in different sets of holes. In an alternative embodiment, shelf clips may not be used and the shelves can be mounted using a different technique such as fasteners, permanently mounted shelf stops, etc.

In an illustrative embodiment, the first shelf 600 and the second shelf 605 are designed to fit inside the assembled support frame. Each cabinet can include a standard bottom panel (or first shelf) made out of HDPE, and a 1/16 inch space can be provided around the edges (including the notches) to allow each shelf or floor to fit without friction. The back of the shelves are designed to sit flush against the back lateral stringers. In an illustrative embodiment, the first shelf 600 and the second shelf 605 can be identical to one another. Any suitable material can be used to form the shelves, including wood, PVC, metal, etc.

Figure 7A:
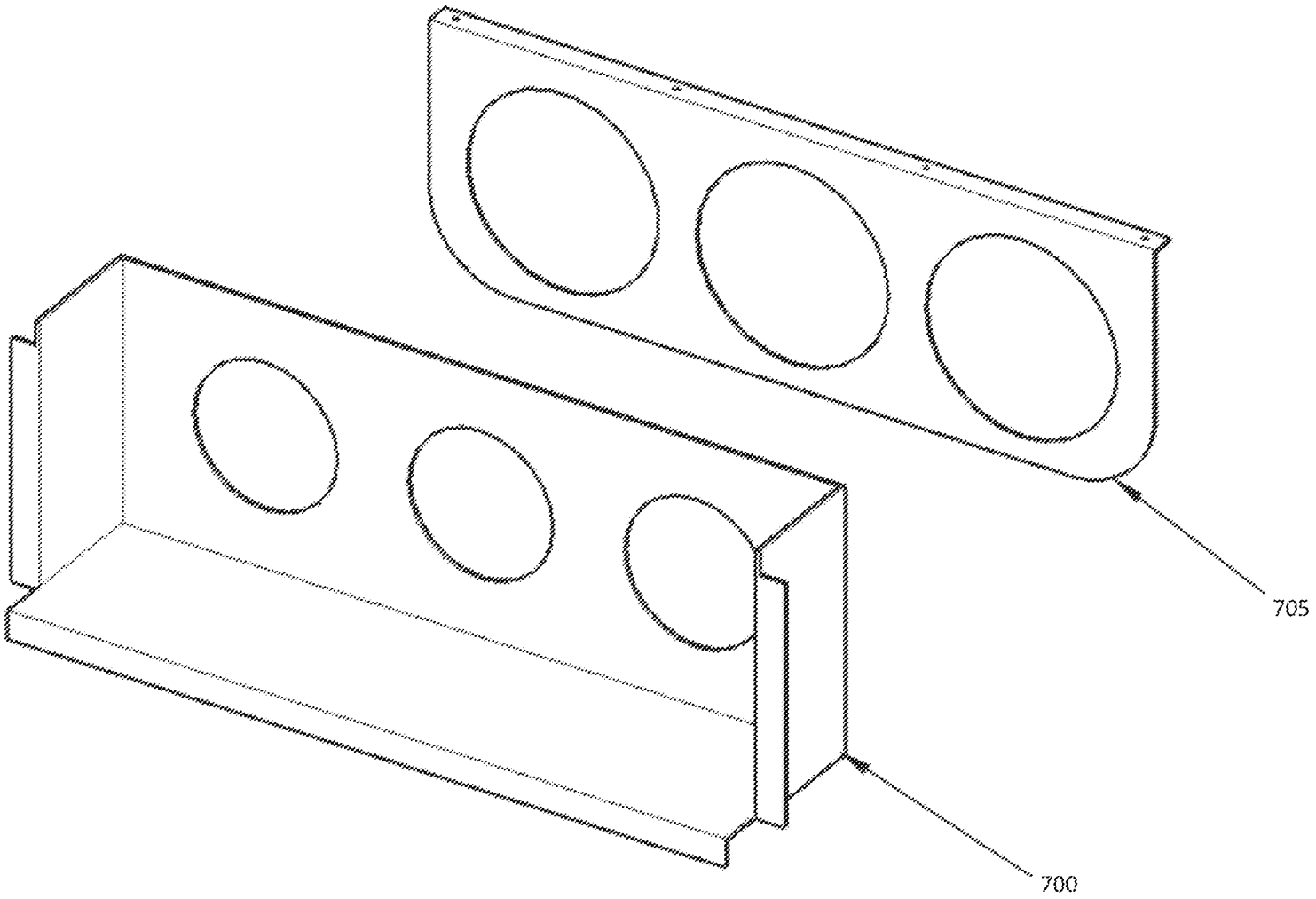
FIG. 7A depicts a cup dispenser accessory in accordance with an illustrative embodiment.

The proposed modular tube frame cabinet system is also designed to optionally accommodate accessories. FIG. 7A depicts a cup dispenser accessory in accordance with an illustrative embodiment. The cup dispenser accessory includes a tray 700 and a cover 705 that mounts to the tray 700. The cup dispenser accessory mounts to the top front of the assembled support frame. In an illustrative embodiment, when used, the cup dispenser accessory replaces one of the (upper) horizontal stringers and provides horizontal attachment between the vertical end supports or between a vertical end support and a vertical center support. The cup dispenser accessory is used to hold and dispense cup or lids.

Figure 7B:
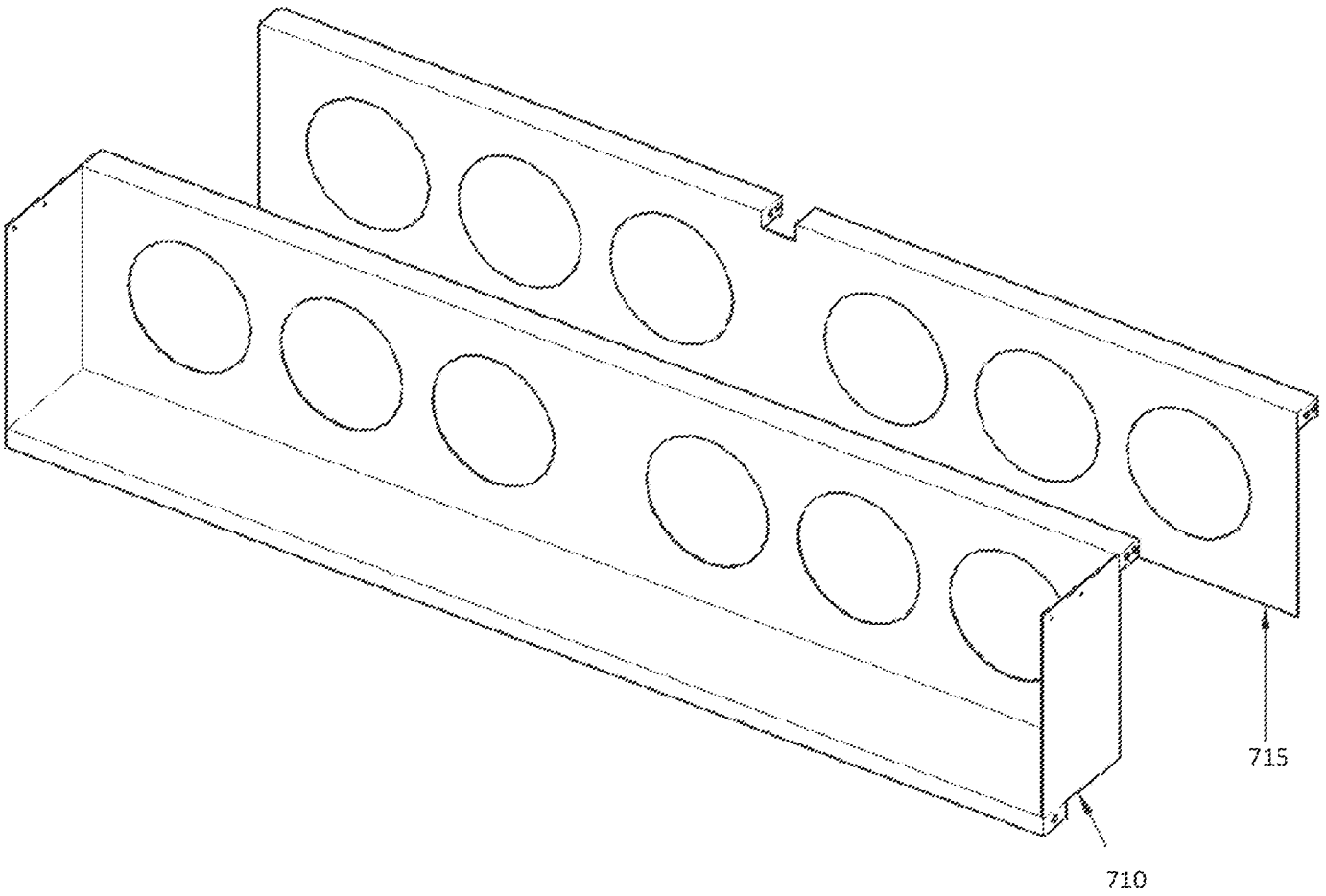
FIG. 7B depicts a condiment dispenser accessory in accordance with an illustrative embodiment.

In alternative embodiments, different accessories can also be used with the proposed system. For example, FIG. 7B depicts a condiment dispenser accessory in accordance with an illustrative embodiment. The condiment dispenser accessory includes a tray 710 and a cover 715 that mounts to the tray 710. In an illustrative embodiment, the condiment dispenser accessory can mount to the system in the same way as the cup dispenser accessory (i.e., such that it replaces one of the (upper) horizontal stringers and provides horizontal attachment between the vertical end supports or between a vertical end support and a vertical center support.

Figure 7D:
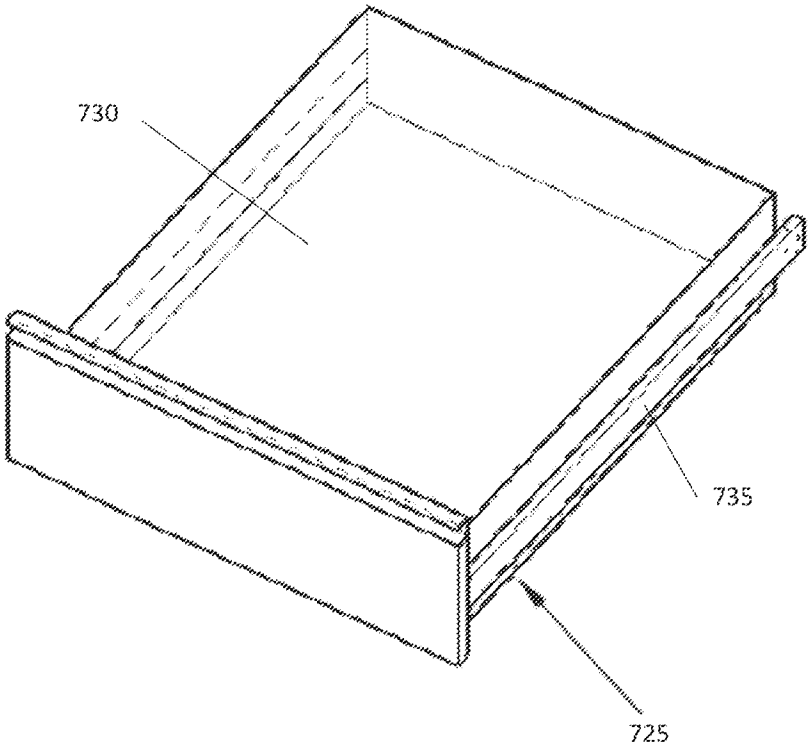
FIG. 7D depicts a drawer and slide accessory in accordance with an illustrative embodiment.
Figure 7C:
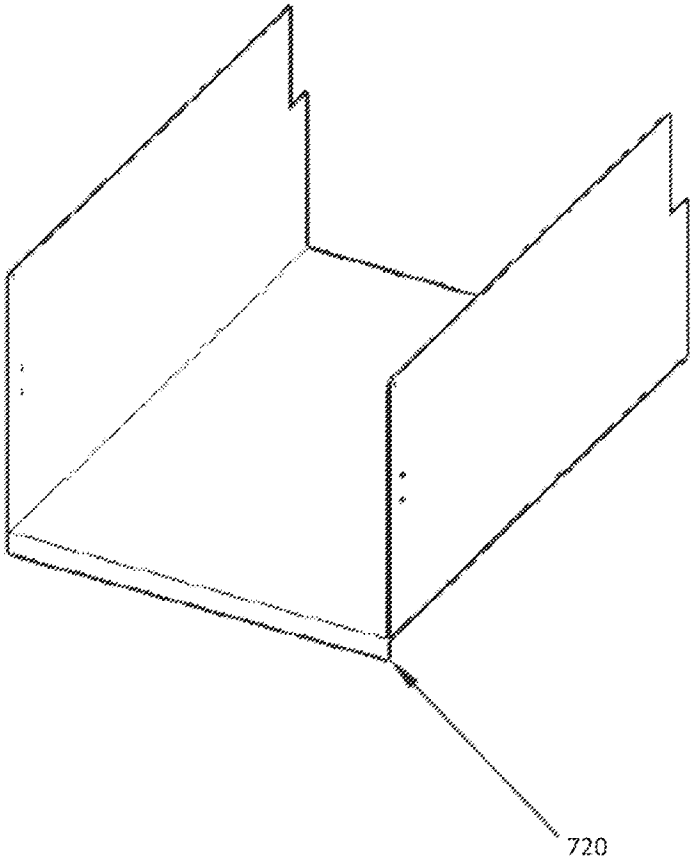
FIG. 7C depicts an under counter apron accessory in accordance with an illustrative embodiment.

FIG. 7C depicts an under counter apron accessory 720 in accordance with an illustrative embodiment. The under counter apron accessory 720 mounts to the frame to provide a storage receptacle under the countertop. For example, the under counter apron accessory 720 can mount to vertical end supports, a vertical center support, and/or horizontal/lateral stringers. The under counter apron accessory 720 can be used for storage, to house a microwave or other appliance, etc.

FIG. 7D depicts a drawer and glide accessory 725 in accordance with an illustrative embodiment In an illustrative embodiment, the drawer and glide accessory 725 includes a storage drawer 725 with a pair of glides 735 mounted thereto. The glides 735 can mount directly to the support frame (e.g., the vertical supports) of the system. In alternative embodiments, other accessories may be similarly used and mounted to the system such as brochure holders, trash receptacles, etc. In addition to being mounted to the front of the system, the accessories can also be mounted to the side(s) of the system. Also, multiple accessories can be mounted to a single cabinet system, if space allows.

Figure 8:
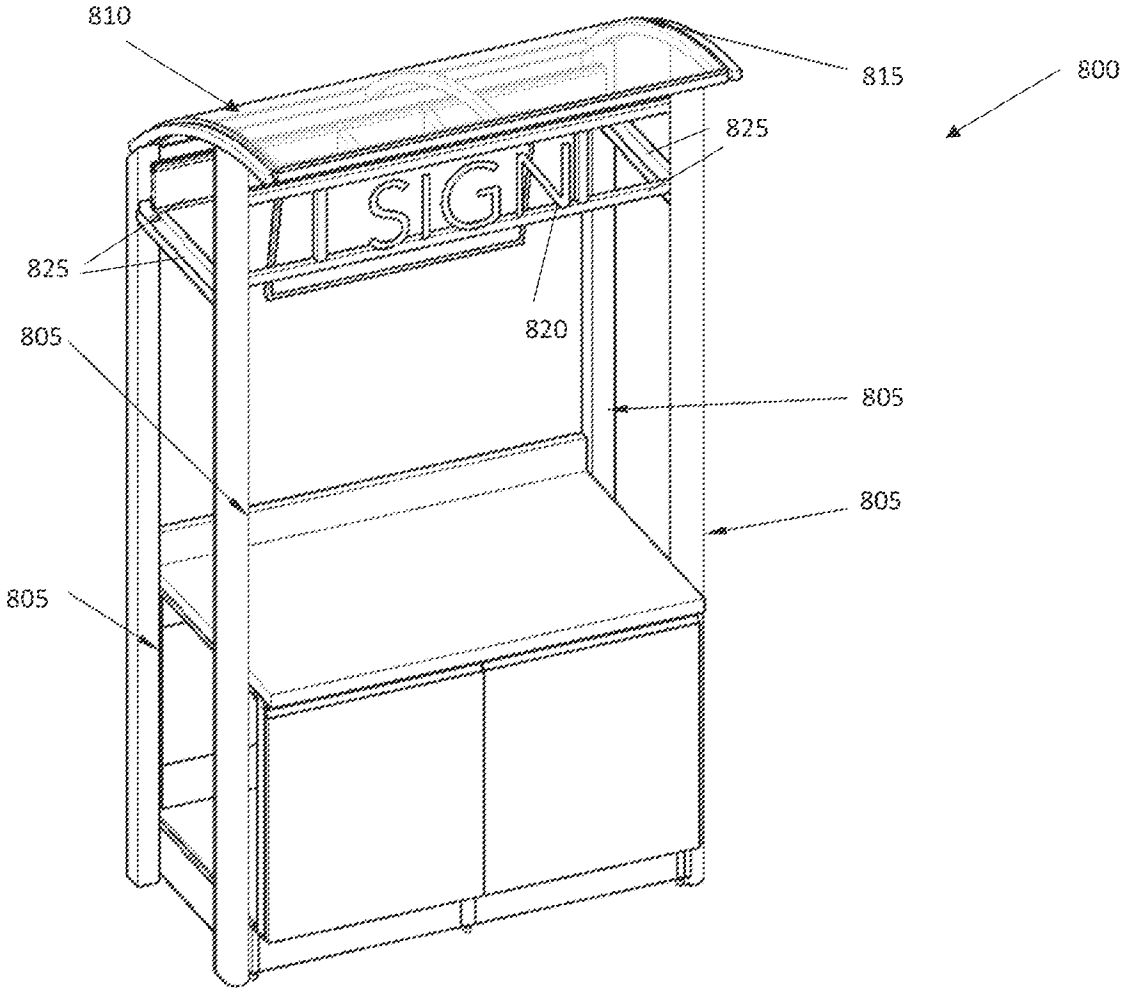
FIG. 8 depicts a kiosk formed using the proposed cabinet system in accordance with an illustrative embodiment.

The proposed cabinet systems can also be further customized to create kiosks and carts. FIG. 8 depicts a kiosk 800 formed using the proposed cabinet system in accordance with an illustrative embodiment. The kiosk is formed in part by mounting vertical posts 805 to each corner of the cabinet system. In an illustrative embodiment, the vertical posts 805 mount directly to the front and back vertical bars of the vertical end supports. A canopy system 810 is mounted to tops of the vertical posts 805 to provide a roof 815 for the kiosk 800. The canopy system 810 also includes a sign 820 and structural supports 825 to increase the integrity of the unit.

Figure 9B:
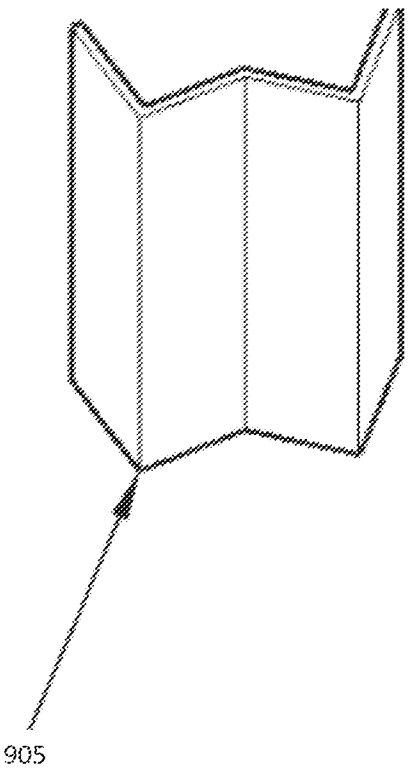
FIG. 9B depicts an attachment bracket that can be used to attach cabinet systems at 45 degree angles in accordance with an illustrative embodiment.
Figure 9A:
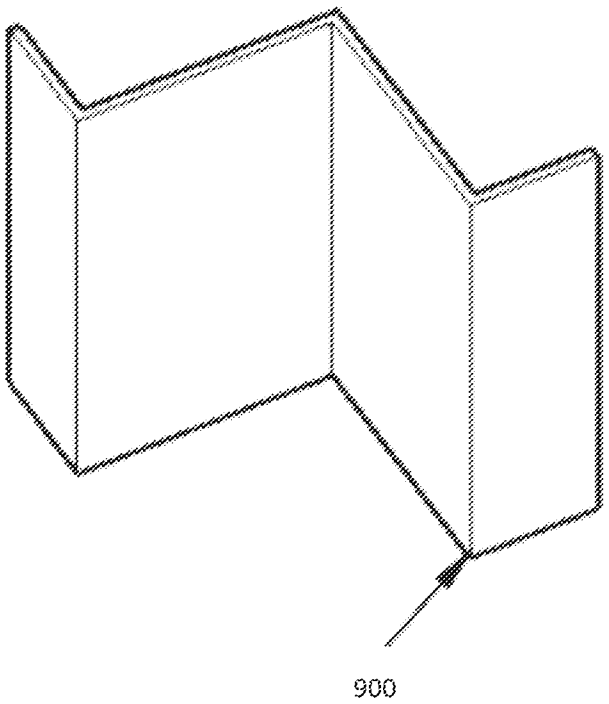
FIG. 9A depicts an attachment bracket that can be used to attach cabinet systems at right angles in accordance with an illustrative embodiment.

As also discussed herein, a plurality of different cabinet systems (of differing sizes) can be connected to another to form long lengths of cabinets, food courts, etc. In addition to being connected in straight lines, attachment brackets can be used to attach cabinet systems at angles relative to one another. FIG. 9A depicts an attachment bracket 900 that can be used to attach cabinet systems at right angles in accordance with an illustrative embodiment. FIG. 9B depicts an attachment bracket 905 that can be used to attach cabinet systems at 45 degree angles in accordance with an illustrative embodiment. In alternative embodiments, different types of attachment brackets may be used to achieve different attachment angles, such as 30 degrees, 40 degrees, 60 degrees, etc. In an illustrative embodiment, the attachment brackets are used to fill in the toe kick space at the bottom of finished cabinets systems when they meet at an inside or outside corner at a specified angle (i.e, 90 degrees for the attachment bracket 900 and 45 degrees for the attachment bracket 905). The attachment brackets can be made with 16 gauge steel and powder coated black in one embodiment. Alternatively, a different material, thickness, coating, etc. may be used.

Figure 10D:
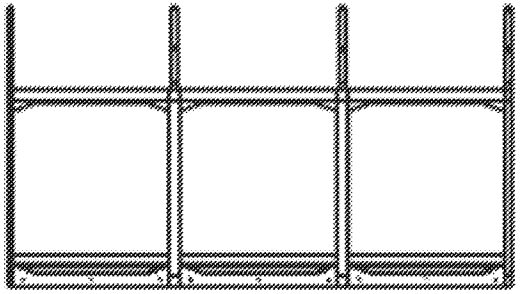
FIG. 10D depicts a cabinet system with two vertical center supports and extension brackets mounted thereto in accordance with an illustrative embodiment.
Figure 10C:
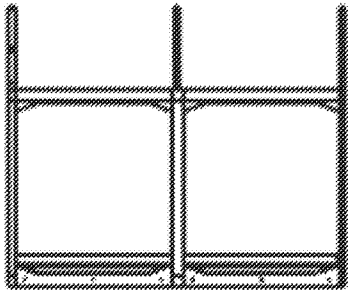
FIG. 10C depicts a cabinet system with a vertical center support and extension brackets mounted thereto in accordance with an illustrative embodiment.
Figure 10B:
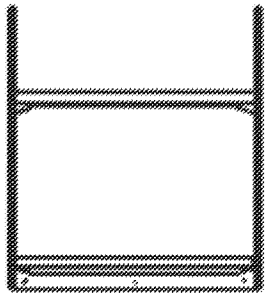
FIG. 10B depicts a single cabinet system of a second size with extension brackets mounted thereto in accordance with an illustrative embodiment.
Figure 10A:
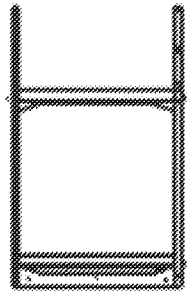
FIG. 10A depicts a single cabinet system of a first size with extension brackets mounted thereto in accordance with an illustrative embodiment.

FIGS. 10A-10J depict various cabinet system configurations that can be assembled with and without using attachment brackets. FIG. 10A depicts a single cabinet system of a first size with extension brackets mounted thereto in accordance with an illustrative embodiment. FIG. 10B depicts a single cabinet system of a second size with extension brackets mounted thereto in accordance with an illustrative embodiment. FIG. 10C depicts a cabinet system with a vertical center support and extension brackets mounted thereto in accordance with an illustrative embodiment. FIG. 10D depicts a cabinet system with two vertical center supports and extension brackets mounted thereto in accordance with an illustrative embodiment.

Figure 10G:
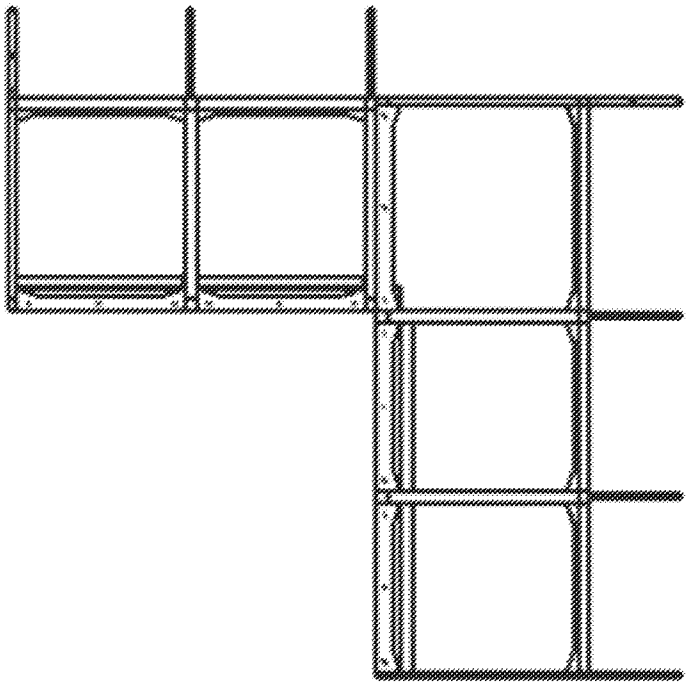
FIG. 10G depicts two cabinet systems attached to one another at a right angle in accordance with an illustrative embodiment.
Figure 10F:
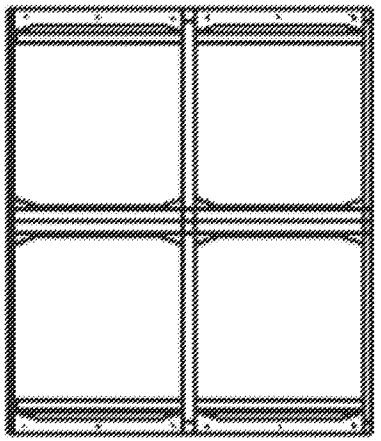
FIG. 10F depicts two cabinet systems attached to form an island in accordance with a second illustrative embodiment.
Figure 10E:
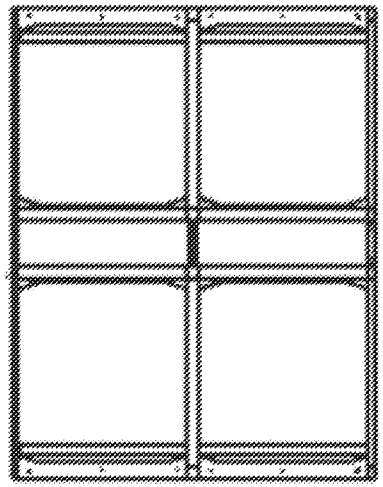
FIG. 10E depicts two cabinet systems attached to form an island in accordance with a first illustrative embodiment.

FIG. 10E depicts two cabinet systems attached to form an island in accordance with a first illustrative embodiment. Each of the two cabinet systems in FIG. 10E includes a vertical center support, and extension brackets are included between the two cabinet systems to form an overall larger island. FIG. 10F depicts two cabinet systems attached to form an island in accordance with a second illustrative embodiment. Each of the two cabinet systems in FIG. 10F includes a vertical center support, and extension brackets are not included between the two cabinet systems in this embodiment.

FIG. 10G depicts two cabinet systems attached to one another at a right angle in accordance with an illustrative embodiment. The two cabinet systems of FIG. 10G can be connected using one or more of the attachment bracket 900 described above. Additionally, as shown, each of the two cabinet systems of FIG. 10G includes bracket extensions extending toward the back of the system. The cabinet systems of FIG. 10G include a first cabinet system that includes two vertical center supports and a second cabinet system that includes a single vertical center support.

Figure 10I:
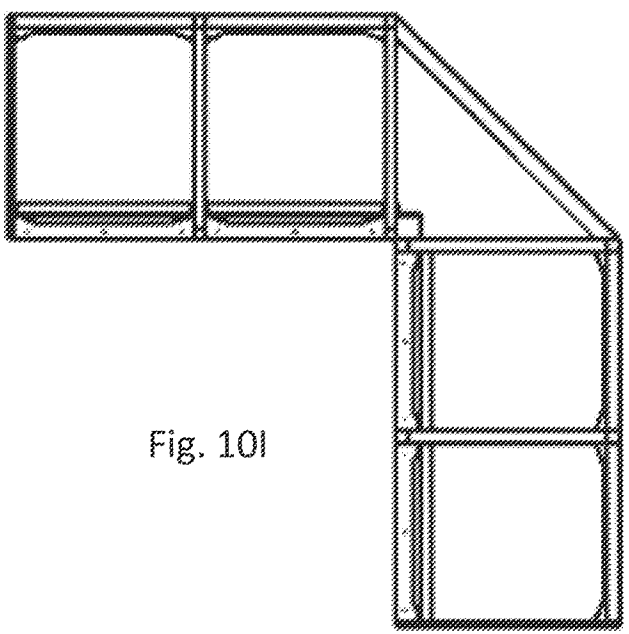
FIG. 10I depicts two cabinet systems attached to one another at a 90 degree angle in accordance with an illustrative embodiment.
Figure 10J:
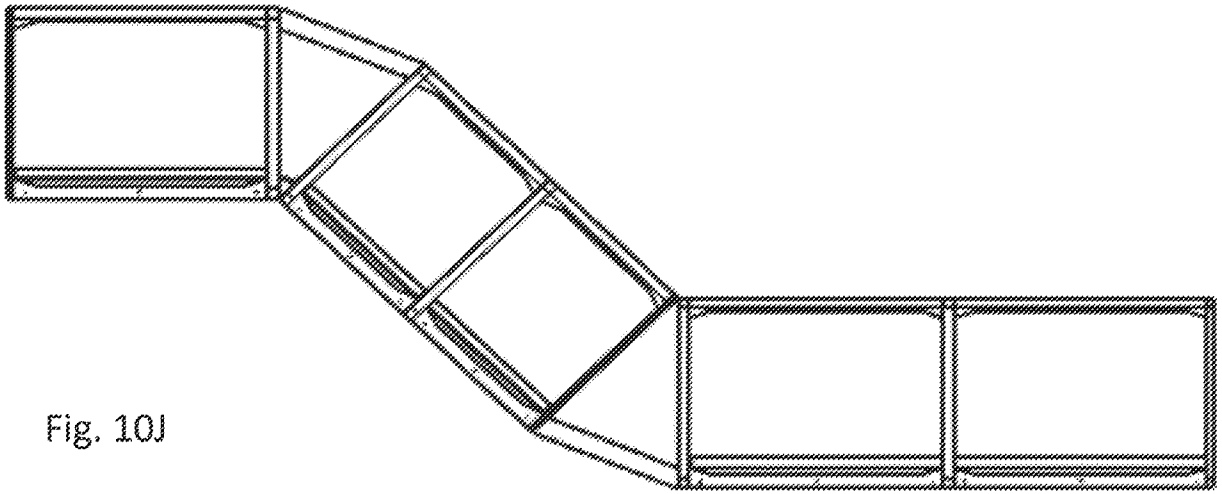
FIG. 10J depicts three cabinet systems attached to one another at 45 degree angles in accordance with an illustrative embodiment.
Figure 10H:
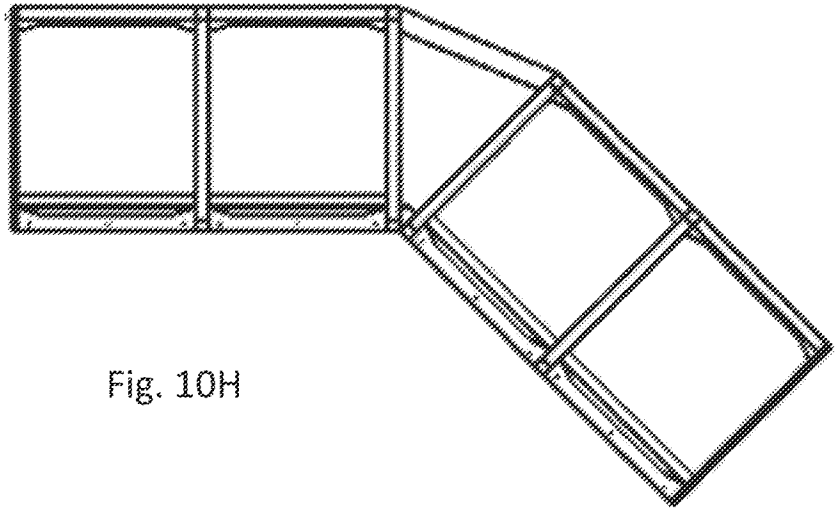
FIG. 10H depicts two cabinet systems attached to one another at a 45 degree angle in accordance with an illustrative embodiment.

FIG. 10H depicts two cabinet systems attached to one another at a 45 degree angle in accordance with an illustrative embodiment. Each of the two cabinet systems in FIG. 10H includes a single vertical center support. Additionally, a panel is used to cover the 45 degree opening formed at the juncture of the two cabinet systems. FIG. 10I depicts two cabinet systems attached to one another at a 90 degree angle in accordance with an illustrative embodiment. Each of the two cabinet systems in FIG. 10I includes a single vertical center support. A panel is also used to cover the 90 degree opening formed at the juncture of the two cabinet systems. FIG. 10J depicts three cabinet systems attached to one another at 45 degree angles in accordance with an illustrative embodiment. As shown, panels are used to cover up the 45 degree openings formed at the junctions between cabinet systems.

Thus, the proposed system makes it possible to easily design a wide variety of in-line, curved, angled, island, etc. configurations to accommodate available space requirements which may be manufactured from stock items. The system is also designed to accommodate customizable elements such as panels, signs, decorations, accessories, doors, etc. that can be simply attached via pre-drilled holes and fasteners.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more".

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A cabinet system, comprising:

a first vertical end support and a second vertical end support, wherein the first vertical end support and the second vertical end support are each formed from a plurality of metal tubes;

a plurality of horizontal stringers that extend between the first vertical end support and the second vertical end support, wherein one or more of the horizontal stringers is configured to support a countertop, wherein each horizontal stringer includes a flat surface with a first sidewall extending from an outer edge of the flat surface, a second sidewall extending from a first side edge of the flat surface, and a third sidewall extending from a second side edge of the flat surface, wherein a fourth side of the flat surface includes a first tapered portion that extends from the first side edge, a second tapered portion that extends from the second side edge, and an inner edge that extends between the first tapered portion and the second tapered portion, and further comprising a flange mounted at an angle to the inner edge that extends between the first tapered portion and the second tapered portion to increase structural integrity; and a plurality of lateral stringers that extend between the first vertical end support and the second vertical end support, wherein at least one of the lateral stringers is a toe kick, and wherein each of the lateral stringers includes a flat surface with three sidewalls extending therefrom.

2. The cabinet system of claim 1, wherein the first vertical end support and the second vertical end support each include a rear vertical bar that extends upward from a ground surface upon which the cabinet system is placed.

3. The cabinet system of claim 2, wherein the first vertical end support and the second vertical end support each include a bottom horizontal bar that extends between the rear vertical bar and a front vertical bar, wherein the bottom horizontal bar is mounted to the rear vertical bar such that there is a gap between the ground surface and a bottom of the bottom horizontal bar.

4. The cabinet system of claim 3, wherein the first vertical end support and the second vertical end support each include a vertical leg mounted to the bottom of the bottom horizontal bar with a setback from a front surface of the front vertical bar to accommodate a front toe kick.

5. The cabinet system of claim 1, wherein at least one of the lateral stringers includes keyhole openings that are used to mount the lateral stringer as the toe kick.

6. The cabinet system of claim 1, further comprising a first extension bracket and a second extension bracket, wherein the first extension bracket mounts to a rear surface of the first vertical end support and the second extension bracket mounts to a rear surface of the second vertical end support.

7. The cabinet system of claim 6, wherein the first extension bracket includes first openings that mount the first extension bracket to the rear surface of the first vertical end support at a first orientation, and second openings that mount the first extension bracket to the rear surface of the first vertical end support at a second orientation.

8. The cabinet system of claim 7, wherein the first extension bracket extends a first distance from the rear surface of the first vertical end support at the first orientation and a second distance from the rear surface of the first vertical end support at the second orientation, wherein the first distance is greater than the second distance.

9. The cabinet system of claim 6, further comprising the countertop, wherein the countertop is mounted over a top surface of the first vertical end support, the second vertical end support, the first extension bracket, and the second extension bracket, and wherein the countertop includes an opening positioned in a portion of the countertop that is behind the rear surface of the first vertical end support and the second vertical end support in space formed by the first extension bracket and the second extension bracket.

10. The cabinet system of claim 1, further comprising an accessory that includes a tray and a cover that mounts to the tray, wherein accessory mounts to at least the first vertical end support, and wherein the accessory replaces one of the plurality of horizontal stringers.

11. The cabinet system of claim 10, wherein the accessory comprises a cup dispenser accessory or a condiment dispenser accessory.

12. The cabinet system of claim 1, further comprising an under counter apron accessory that mounts under the countertop, wherein the under counter apron accessory mounts to at least the first vertical end support to form a storage receptacle.

13. The cabinet system of claim 1, further comprising a first drawer glide mounted to the first vertical end support and a second drawer glide mounted to the second vertical end support, wherein the first drawer glide and the second drawer glide support a drawer that mounts under the countertop.

14. A method of forming a cabinet system, comprising:

forming a first vertical end support and a second vertical end support from a plurality of metal tubes;

forming a plurality of horizontal stringers that extend between the first vertical end support and the second vertical end support, wherein one or more of the horizontal stringers is configured to support a countertop wherein each horizontal stringer includes a flat surface with a first sidewall extending from an outer edge of the flat surface, a second sidewall extending from a first side edge of the flat surface, and a third sidewall extending from a second side edge of the flat surface, wherein a fourth side of the flat surface includes a first tapered portion that extends from the first side edge, a second tapered portion that extends from the second side edge, and an inner edge that extends between the first tapered portion and the second tapered portion, and further comprising a flange mounted at an angle to the inner edge that extends between the first tapered portion and the second tapered portion to increase structural integrity; and forming a plurality of lateral stringers that extend between the first vertical end support and the second vertical end support, wherein at least one of the lateral stringers is formed as a toe kick, and wherein each of the lateral stringers is formed to include a flat surface with three sidewalls extending therefrom.

15. The method of claim 14, further comprising forming a first extension bracket and a second extension bracket, wherein the first extension bracket mounts to a rear surface of the first vertical end support and the second extension bracket mounts to a rear surface of the second vertical end support.

16. The method of claim 14, further comprising forming an accessory that includes a tray and a cover that mounts to the tray, wherein accessory mounts to at least the first vertical end support, and wherein the accessory replaces one of the plurality of horizontal stringers.

17. The method of claim 14, wherein forming the first vertical end support comprises:

forming a front vertical bar, forming a rear vertical bar that extends upward from a ground surface upon which the cabinet system is placed;

mounting a bottom horizontal bar between the rear vertical bar and a front vertical bar, wherein the bottom horizontal bar is mounted to the rear vertical bar such that there is a gap between the ground surface and a bottom of the bottom horizontal bar; and mounting a vertical leg to the bottom of the bottom horizontal bar with a setback from a front surface of the front vertical bar.

* * * * *